United States Patent [19]

Oya et al.

[11] 4,321,850

[45] Mar. 30, 1982

[54] ELECTRONIC MUSICAL INSTRUMENT WITH HIGHEST PRIORITY KEY TONE PRODUCTION

[75] Inventors: Akiyoshi Oya, Hamamatsu; Yasuji Uchiyama, Hamakita, both of Japan

[73] Assignee: Nippon Gakki Seizo Kabushiki Kaisha, Japan

[21] Appl. No.: 145,553

[22] Filed: May 1, 1980

[30] Foreign Application Priority Data

May 5, 1979 [JP] Japan ..... 54-54858
Jun. 21, 1979 [JP] Japan ..... 54-77515

[51] Int. Cl.[3] ..... G10H 1/22

[52] U.S. Cl. ..... 84/1.01; 84/DIG. 2; 307/231; 328/137; 328/154; 340/825.5

[58] Field of Search ..... 84/1.01, DIG. 2; 307/231; 328/137, 154; 340/147 LP

[56] References Cited

U.S. PATENT DOCUMENTS

| | | | |
|---|---|---|---|
| 4,138,916 | 2/1979 | Kitagawa | 84/1.01 |
| 4,138,917 | 2/1979 | Sakashita et al. | 84/1.01 |
| 4,141,268 | 2/1979 | Kugisawa | 84/1.01 X |
| 4,148,017 | 4/1979 | Tomisawa | 84/1.01 X |
| 4,170,768 | 10/1979 | Kitagawa | 84/1.01 X |
| 4,184,401 | 1/1980 | Hiyoshi et al. | 84/1.01 X |
| 4,192,211 | 3/1980 | Yamaga et al. | 84/1.01 |
| 4,194,425 | 3/1980 | Kitagawa | 84/1.01 |
| 4,269,102 | 5/1981 | Kondo et al. | 84/1.01 |
| 4,271,743 | 6/1981 | Uchiyama | 84/DIG. 2 |

FOREIGN PATENT DOCUMENTS 2856043 5/1979 Fed. Rep. of Germany ... 84/DIG. 2

*Primary Examiner*—S. J. Witkowski
*Attorney, Agent, or Firm*—Townsend and Townsend

[57] ABSTRACT

An electronic musical instrument having a plurality of keys is provided with a depressed key detector which detects depressed keys and produces key identifying signals; a highest signal detector which detects a highest one among the key identifying signals having a highest priority in accordance with a predetermined order of priority; a musical tone producing unit responsive to the detected highest signal for producing a musical tone of a tone pitch corresponding to the highest signal; a reference memory device for storing the detected highest signal in accordance with a predetermined condition; and a controller for inhibiting the musical tone producing unit from producing the musical tone according to a relationship between the detected highest signal and an output of the reference memory device.

Thus the progression of simultaneous plural key depressions provides a melody performance including rests.

8 Claims, 14 Drawing Figures

ELECTRONIC MUSICAL INSTRUMENT WITH HIGHEST PRIORITY KEY TONE PRODUCTION

BACKGROUND OF THE INVENTION

This invention relates to an electronic musical instrument, more particularly to an electronic musical instrument which produces musical tones of the highest or lowest tone pitch among the depressed keys.

In an electronic musical instrument, usually an accompaniment is played in a lower tone range (a lower keyboard), while a melody is played in a higher tone range (an upper keyboard). However, to emphasize the melody performance it has already been proposed to detect, for example, the highest pitch among the depressed keys and to produce the highest pitch tone with a tone color different from that of a main musical tone producing system by a special musical tone producing system different from the main musical tone producing system, as disclosed for example in a copending U.S. patent application Ser. No. 114,733 filed on Jan. 24, 1980 under a title of "Electronic Musical Instrument with Intermanual Performance Faculty". With this electronic musical instrument, while the melody performance is continued (at least one key is being depressed for the melody), the highest tone pitch of the melody performance tones can be produced by a special musical tone generating system with a tone color different from that of a main musical tone generating system. The melody performance tone is emphasized to provide a special effect. However, when the melody performance is momentarily interrupted (i.e. the moment when the melody is at a rest and no key is being depressed for the melody) with the accompaniment performance being done in the lower tone range, the highest tone pitch detected is the highest tone pitch among the accompaniment keys with the result that this highest tone pitch of the accompaniment performance tones is now produced by the special musical tone generating system. Accordingly, when the melody performance is momentarily interrupted, the musical tone generated by the special musical tone generating system is abruptly transferred to the accompaniment note thus producing an extremely unnatural progression.

SUMMARY OF THE INVENTION

Accordingly, it is an object of this invention to provide a novel electronic musical instrument capable of preventing a big change in the pitch of the highest or lowest tone when the melody or accompaniment performance is momentarily interrupted in an electronic musical instrument system in which a special musical tone is generated by detecting the highest or lowest one of the simultaneously depressed keys.

Thus, according to this invention in the system of the type described above, where a newly detected highest or lowest key is more than a predetermined interval apart from a previously detected highest or lowest key, the generation of the newly detected highest or lowest key is precluded.

A judgement whether the new highest or lowest key is apart from the previous highest or lowest key by more than a predetermined note interval or not is made by storing the information of the previously detected highest or lowest keys one after another and comparing the newly detected highest or lowest key information with the stored key information.

According to this invention there is provided an electronic musical instrument comprising a plurality of keys, a depressed key detector which detects a plurality of depressed keys among the keys for producing key identifying signals corresponding to the depressed keys, a highest signal detector which detects a highest signal among the key indentifying signals having a highest priority in accordance with a predetermined order of priority, a musical tone producing unit responsive to the detected highest signal for producing a musical tone of a tone pitch corresponding to the highest signal, a reference memory device for storing the detected highest signal in accordance with a predetermined condition, and a controller for inhibiting the musical tone producing unit from producing the musical tone according to a relationship between the detected highest signal and an output of the reference memory device.

BRIEF DESCRIPTION OF THE ACCOMPANYING DRAWINGS

Figure 1:
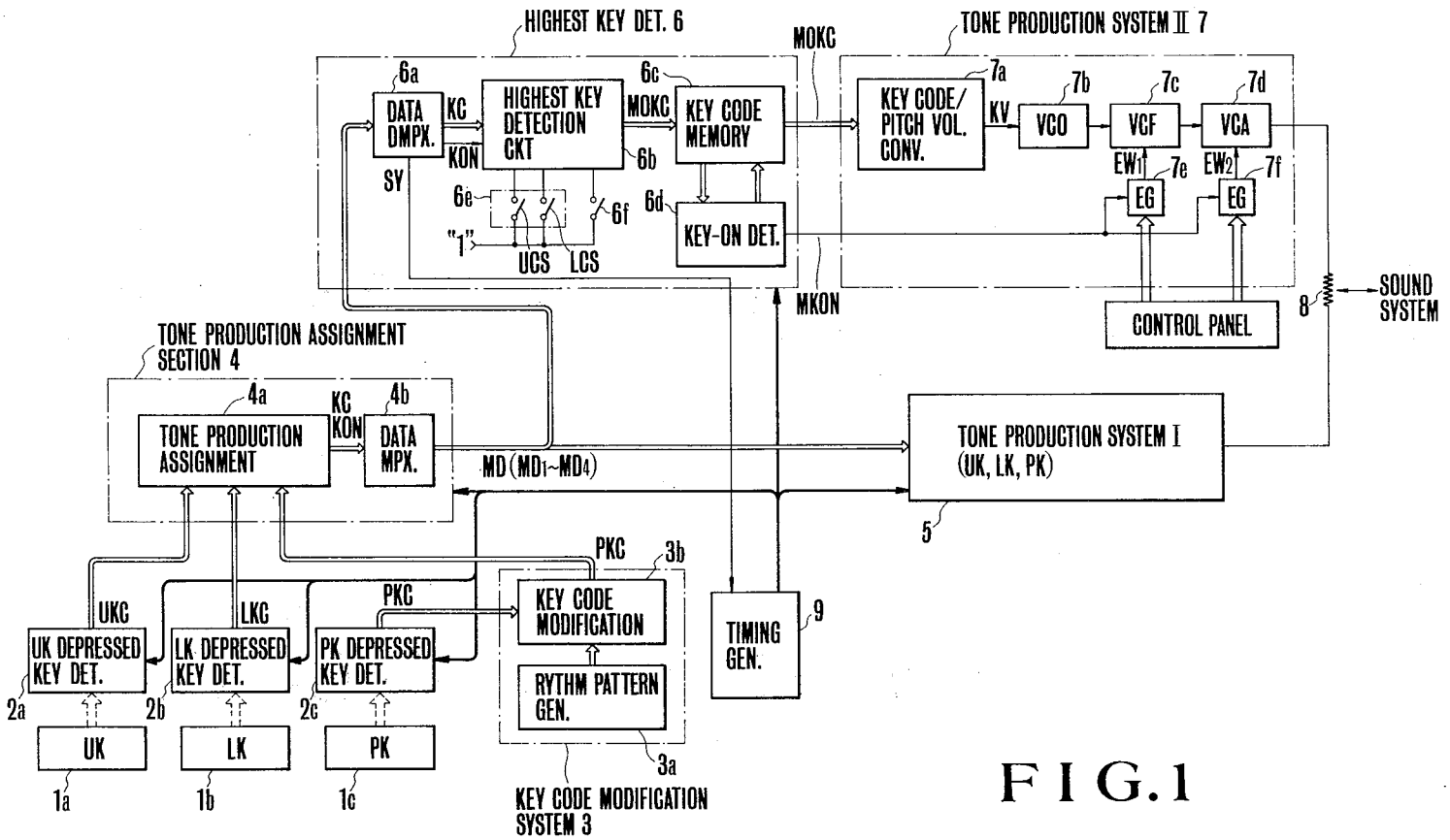
FIG. 1 is a general block diagram showing one embodiment of an electronic musical instrument embodying the invention.

DESCRIPTION OF THE PREFERRED EMBODIMENTS (1) General Description.

A preferred embodiment of this invention shown in FIG. 1 generally comprising an upper keyboard (UK) 1*a*, a lower keyboard (LK) 1*b*, a pedal keyboard (PK) 1*c*, a UK depressed key detector 2*a*, an LK depressed key detector 2*b* and a PK depressed key detector 2*c* which detect depressed keys of respective keyboards for producing encoded key informations (hereinafter termed as key codes KC), UKC, LKC and PKC representing depressed keys of respective keyboards, a key code modification system 3 which produces walking bass tones by suitably modifying a key code PKC produced by the PK depressed key detector 2*c* according to a selected bass pattern, and a tone production assignment section 4 which is supplied with the key codes UKC and LKC outputted from the UK and LK depressed key detectors 2*a* and 2*b* and a key code PKC outputted from the key code modification system 3 for assigning these key codes to available ones of a plurality of tone production channels (in this example, 18 channels) that can produce tones at the same time. There is further provided a first musical tone production system 5 for the upper, lower, and pedal keyboards which is supplied with key codes KC (UKC, LKC, PKC), although in a multiplexed form, assigned to respective tone production channels from the tone production assignment section 4 for producing musical tone signals of tone pitches corresponding to the key codes KC assigned to respective tone production channels. A highest key detector 6 is supplied with the key codes KC, also in a multiplexed form, of respective tone production channels produced by the tone production assignment section 4 for extracting a key code representing the highest tone pitch (highest key) among the key codes KC as a highest tone producing key code MOKC (in the example the order of priority is determined as such that the higher tone pitch key has the higher priority). A second musical tone production system 7 is inputted with the highest tone producing key code MOKC produced by the highest key detector 6 for producing a musical tone signal corresponding to the highest tone producing key code MOKC and having a tone color different from that of the first tone production system 5. A mixing resistor 8 admixes the musical tone signals generated by the first and second tone production systems 5 and 7. A timing signal generator 9 supplies various timing signals to the UK, LK and PK depressed key detectors 2*a* through 2*c*, the tone production assignment section 4, the first tone production system 5 and the highest key detector 6.

The upper keyboard 1*a*, the lower keyboard 1*b* and the pedal keyboard 1*c* are constituted by the keys respectively in charge of the note ranges shown in the following Table I

TABLE I

| keyboard | number of keys | key range |
|---|---|---|
| upper keyboard | 61 | C2 to C7 |
| lower keyboard | 61 | C2 to C7 |
| pedal keyboard | 25 | C2 to C4 |

The PK depressed key detector 2*c* has a function of highest single key selection so that when a plurality of keys in the pedal keyboard 1*c* are simultaneously depressed only a key code PKC corresponding to the key having the highest tone pitch among the depressed keys will be delivered. The UK depressed key detector 2*a* and the LK depressed key detector 2*b* produce key codes UKC and LKC of respective depressed keys in the upper and lower keyboards 1*a* and 1*b* so that when a plurality of keys are depressed concurrently, a plurality of key codes UKC and LKC respectively corresponding to all the the depressed keys are produced. Each of the key codes UKC, LKC and PKC produced by the depressed key detectors 2*a* through 2*c* is constituted by a block code BC representing the octave range of the depressed key and a note code NC representing the note name of the depressed key. The block code BC of key codes UKC, LKC and PKC consists of three bits B3, B2 and B1, and one example of the relationship between their contents and the octave range is shown in the following Table II. The note code NC consists of four bits N4, N3, N2 and N1 and, one example of the relationship of their contents and the note name is shown in the following Table III.

TABLE II

| BC bits | | | octave range | | |
|---|---|---|---|---|---|
| B3 | B2 | B1 | upper keyboard | lower keyboard | pedal keyboard |
| 0 | 0 | 0 | C2 | C2 | C2 |
| 0 | 0 | 1 | C#2 to C3 | C#2 to C3 | C#2 to C3 |
| 0 | 1 | 0 | C#3 to C4 | C#3 to C4 | C#3 to C4 |
| 0 | 1 | 1 | C#4 to C5 | C#4 to C5 | C#4 to C5 |
| 1 | 0 | 0 | C#5 to C6 | C#5 to C6 | |
| 1 | 0 | 1 | C#6 to C7 | C#to C7 | |

TABLE III

| | NC bits | | | | decimal |
|---|---|---|---|---|---|
| note name | N4 | N3 | N2 | N1 | representation |
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 0 | 0 | 12 |

The note code N4 to N1 of the note C is "1100" (decimal 12), and this code is converted into "1111" (decimal 15) when the note code N4 to N1 is actually utilized to generate a musical tone. The reason that the note code N4 to N1 of the note C is not made to be "1111" at the first time is to descriminate it from a synchronizing data having a content of "1111" generated from a data multiplexer as will be described later.

The key code modification system 3 performs such arithmetic operation as addition or subtraction of bass pattern data (which are digital data that vary according to rythms) generated by a rythm pattern generator 3*a* and a key code PKC generated by the PK depressed key detector 2*c* by using a key code modification circuit 3*b* for enabling to produce walking bass tones by merely depressing a single key of the pedal keyboard 1*c* necessary to produce a key code PKC.

The tone production assignment section 4 is constituted by a tone production assignment circuit 4*a* and a data multiplexer 4*b*. The tone production assignment circuit 4*a* operates to assign key codes UKC, LKC and PKC respectively produced by the UK and LK depressed key detectors 2*a* and 2*b* and the key code modification circuit 3*b* to respective tone production channels for producing, in a time division multiplexed fashion, the key codes KC (UKC, LKC, PKC) assigned to respective channels and key-on signals KON representing the ON.OFF states of the respective keys corresponding to the assigned key codes KC for respective tone production channels according to a clock signal $\phi$1 shown at (a) in FIG. 3. The key-on signal KON is "1" while the key is depressed but becomes "0" when the key is released.

In this embodiment, the tone production channels are predetermined for each keyboard and the tone production assigner 4*a* assigns the key codes (UKC, LKC, PKC) of the allotted keyboard to either one of the predetermined tone production channels. One example of the tone production channels assigned with the key codes UKC, LKC and PKC of respective keyboards is shown in the following Table IV.

TABLE IV

| | tone production channels to be assigned (No.) |
|---|---|
| key codes UKC of upper keyboard | 2, 4, 5, 7, 10, 13, 16 |
| key codes LKC of lower key code | 3, 6, 8, 9, 11, 14, 17 |
| key codes PKC of pedal keyboard | 1 |

The 12th, 15th and 18th tone production channels are used to play special performances such as arpeggio and are assigned with key codes for the arpeggio performance instead of key codes UKC, LKC and PKC. However, as this is immaterial to this invention it will not be described herein.

The data multiplexer **4*b* multiplexes the key codes KC and the key-on signals KON for respective channels produced by the tone production assigner 4*a* into data MD (MD1 to MD4) having bits of a number smaller than all the bits assigned to respective tone production channels. The data multiplexer 4*b*** multiplexes the key code KC and the key-on signal KON of each of the first to 18th tone production channels in each multiplex channel time.

As shown in the following Table V, each multiplex channel time is constituted by first through third states having a unit state equal to one period of the clock signal $\phi$1 ((a) of FIG. 3). Thus, each multiplex channel time has a time length of 3 periods of the clock signal $\phi$1.

In the first state of the first multiplex channel time, a synchronizing data "1111" is generated to demultiplex or demodulate the multiplexed data MD in the first musical tone production system 5 and the highest key detector 6. In the second state of each multiplex channel time, the block code B1 to B3 of the key code KC and the key-on signal KON are transmitted as the bits MD1 to MD4. Further, in the third state of each multiplex channel time, the note codes N1 to N4 of the key code KC are transmitted as the bits MD1 to MD4.

"UK", "LK" and "PK" shown in the column of "keyboard" in Table V show channels respectively assigned exclusively to the key codes (UKC, LKC, PKC) of the upper, lower and pedal keyboards.

TABLE V

| multiplex channel time | | 1 | | | 2 | | | 3 | | | 4 | | |
|---|---|---|---|---|---|---|---|---|---|---|---|---|---|
| state | | 1 | 2 | 3 | 1 | 2 | 3 | 1 | 2 | 3 | 1 | 2 | 3 |
| MD | MD1 | "1" | B1 | N1 | "0" | B1 | N1 | "0" | B1 | N1 | "0" | B1 | N1 |
| | MD2 | "1" | B2 | N2 | "0" | B2 | N2 | "0" | B2 | N2 | "0" | B2 | N2 |
| | MD3 | "1" | B3 | N3 | "0" | B3 | N3 | "0" | B3 | N3 | "0" | B3 | N3 |
| | MD4 | "1" | KON | N4 | "0" | KON | N4 | "0" | KON | N4 | "0" | KON | N4 |
| keyboard | | | PK | | | UK | | | UK | | | UK | |
| tone production channel | | | 1 | | | 4 | | | 7 | | | 10 | |

| multiplex channel time | | 5 | | | 6 | | | 7 | | | 8 | | |
|---|---|---|---|---|---|---|---|---|---|---|---|---|---|
| state | | 1 | 2 | 3 | 1 | 2 | 3 | 1 | 2 | 3 | 1 | 2 | 3 |
| MD | MD1 | "0" | B1 | N1 | "0" | B1 | N1 | "0" | B1 | N1 | "0" | B1 | N1 |
| | MD2 | "0" | B2 | N2 | "0" | B2 | N2 | "0" | B2 | N2 | "0" | B2 | N2 |
| | MD3 | "0" | B3 | N3 | "0" | B3 | N3 | "0" | B3 | N3 | "0" | B3 | N3 |
| | MD4 | "0" | KON | N4 | "0" | KON | N4 | "0" | KON | N4 | "0" | KON | N4 |
| keyboard | | | UK | | | UK | | | UK | | | UK | |
| tone production channel | | | 13 | | | 16 | | | 2 | | | 5 | |

| multiplex channel time | | 9 | | | 10 | | | 11 | | | 12 | | |
|---|---|---|---|---|---|---|---|---|---|---|---|---|---|
| state | | 1 | 2 | 3 | 1 | 2 | 3 | 1 | 2 | 3 | 1 | 2 | 3 |
| MD | MD1 | "0" | B1 | N1 | "0" | B1 | N1 | "0" | B1 | N1 | "0" | B1 | N1 |
| | MD2 | "0" | B2 | N2 | "0" | B2 | N2 | "0" | B2 | N2 | "0" | B2 | N2 |
| | MD3 | "0" | B3 | N3 | "0" | B3 | N3 | "0" | B3 | N3 | "0" | B3 | N3 |
| | MD4 | "0" | KON | N4 | "0" | KON | N4 | "0" | KON | N4 | "0" | KON | N4 |
| keyboard | | | LK | | | UK | | | LK | | | LK | |
| tone production channel | | | 8 | | | 11 | | | 14 | | | 17 | |

| multiplex channel time | | 13 | | | 14 | | | 15 | | | 16 | | |
|---|---|---|---|---|---|---|---|---|---|---|---|---|---|
| state | | 1 | 2 | 3 | 1 | 2 | 3 | 1 | 2 | 3 | 1 | 2 | 3 |
| MD | MD1 | "0" | B1 | N1 | "0" | B1 | N1 | "0" | B1 | N1 | "0" | | |
| | MD2 | "0" | B2 | N2 | "0" | B2 | N2 | "0" | B2 | N2 | "0" | | |
| | MD3 | "0" | B3 | N3 | "0" | B3 | N3 | "0" | B3 | N3 | "0" | | |
| | MD4 | "0" | KON | N4 | "0" | KON | N4 | "0" | KON | N4 | "0" | | |
| keyboard | | | LK | | | UK | | | UK | | | | |
| tone production channel | | | 3 | | | 6 | | | 9 | | | 12 | |

| multiplex channel time | | 17 | | | 18 | | |
|---|---|---|---|---|---|---|---|
| state | | 1 | 2 | 3 | 1 | 2 | 3 |
| MD | MD1 | "0" | | | "0" | | |
| | MD2 | "0" | | | "0" | | |
| | MD3 | "0" | | | "0" | | |
| | MD4 | "0" | | | "0" | | |
| keyboard | | | | | | | |
| tone production channel | | | 15 | | | 18 | |

In the foregoing description regarding the tone production assignment section 4, the tone production assigning circuit 4*a* thereof is constructed to complete one assigning operation during a period in which respective assignment channel times circulate three times (i.e. 54 assignment channel times), that is the multiplex channel times of the first to 18th multiplex channels circulate once. Accordingly, in order to assign three different key codes it is necessary to use a time period in which the first to 18th multiplex channel times circulate three times, but as the assignment is performed at a high speed, the multiplex channel times are extremely short which causes no trouble for the production of the musical tones. Further, the tone production assigning circuit 4*a* is constructed such that it holds and continuously outputs the key codes KC and the key-on signals KON assigned to respective tone production channels. When keys corresponding to the key codes are released, only the key-on signals are cancelled thus continuously outputting only the key codes after the key release because the key codes are necessary for the purpose of realizing the decays of the musical tones. Thereafter, when a new key code KC and a key-on signal KON are assigned to a given tone production channel, the key code KC which has previously been assigned to and held by the channel is released (truncated) and the newly assigned key code and the key-on signals is now held and outputted continuously. Accordingly, the data multiplexer 4*b* sequentially multiplexes and outputs the key code KC and the key-on signal KON produced by the tone production assigner 4*a*, as shown in Table V. Accordingly, once assigned with the signals, the given tone production channel continues to produce key codes (block code BC and note code NC), except for the key-on signal KON, until the next assignment is made to the channel.

The first tone production system 5 operates to demodulate the multiplexed data MD (MD1 to MD4) sent from the tone production assignment section 4 to take out in parallel the key code KC and the key-on signal KON for each tone production channel to generate a musical tone signal having a tone pitch corresponding to the key code KC and the key-on signal of that channel. The musical tone signals thus generated are supplied to a sound system, not shown, via a mixing resistor 8 to generate musical tones corresponding to the depressed keys of the upper, lower and pedal keyboards.

The highest key detector 6 comprises a data demultiplexer 6*a*, a highest key detection circuit 6*b*, a key code memory device 6*c* and a key-on detector 6*d*. The data demultiplexer 6*a* demultiplexes a signal delivered as multiplexed data by the tone production assignment section 4 to produce in parallel the key code KC and the key-on signal KON for each tone production channel; it also converts the note code N4 to N1 of the note C sent from the tone production assignment section 4 in the form of "1100" into "1111" which is the note code N4 to N1 inherent to note C. Further, the data demultiplexer 6*a* detects the aforementioned synchronizing data "1111" contained in the multiplexed data produced by the tone production assignment section 4 and then supplies the detected data to the timing signal generator 9 to synchronize the operation thereof.

The highest key detection circuit 6*b* selects a key code corresponding to a keyboard selected by a keyboard selection switch group 6*c* among the key codes for respective tone production channels produced by the data demultiplexer 6*a* for detecting a key code KC corresponding to the key having the highest tone pitch among the selected key codes KC for sending out the detected key code as the highest key code MOKC. The highest key detector 6*b* is controlled by a highest tone production control switch 6*f* to operate either in a "normal mode" or a "tone production control mode". When the highest tone production control switch 6*f* is off the circuit 6*b* operates in the normal mode to produce the detected key code of the highest tone pitch as the highest key code MOKC, whereas when the tone production control switch 6*f* is on, the mode is changed to the tone production control mode to produce a newly detected key code as the highest key code MOKC only when the newly detected key code KC of the highest tone pitch is within an interval predetermined for a preceding key code of the highest tone pitch of an already released key. Where the key code KC is not included in the interval, the highest key code MOKC is not produced.

The keyboard selection switch group 6*e* is constituted by a UK selection switch UCS, and an LK selection switch LCS. When only the UK selection switch UCS is closed only the highest key code MOKC is selected among the key codes representing the depressed keys of the upper keyboard 1*a*, whereas when only the LK selection switch LCS is closed the highest key code MOKC is detected among the key codes MC representing the depressed keys of the lower keyboard 1*b*. When both UK and LK selection switches UCS and LCS are closed the highest key code MOKC is detected among the key codes KC representing the depressed keys of the upper and lower keyboards 1*a* and 1*b*.

The key code memory device 6*c* temporarily stores the highest key code MOKC produced by the highest key detector 6*d* and then supplies the highest key code to the second musical tone production system 7. Based on the memory state of the key code memory device 6*c*, the key-on detector 6*d* forms a highest key-on signal MKON which is applied to the second tone production system 7. The key-on detector 6*d* compares the input code with the output code of the key code memory device 6*c*. When the input and the output coincide with each other, a highest key-on signal is produced (MKON="1") whereas when they do not coincide with each other, the highest key-on signal is not produced (MKON="0").

The second tone production system 7 comprises a key-code/tone-pitch-voltage converter 7*a*, a voltage controlled frequency variable oscillator (VCO) 7*b*, a voltage controlled characteristic variable filter (VCF) 7*c*, a voltage controlled gain variable amplifier (VCA) 7*d*, and control waveform generators (EG) 7*e* and 7*f* respectively controlling the VCF 7*c* and VCA 7*d*.

The key-code/tone-pitch-voltage converter 7*a* converts the highest key code MOKC in the form of digital data produced by the key code memory device 6*c* into an analogue tone pitch voltage KV corresponding to the highest key code MOKC, and supplies the tone pitch voltage KV to the VCO 7*b* which generates a tone source signal having a frequency determined by the tone pitch voltage KV and supplies the tone source signal to the VCF 7*c*.

On the other hand, the EG 7*e* and EG 7*f* are operated by the highest key-on signal MKON produced by the key-on detection circuit 6*d* to generate control waveforms EW1 and EW2 for the attack, sustain and decay shapes and supplies these control waveforms to the VCF 7*c* and VCA 7*d*. As a consequence, the tone source signal generated by the VCO 7*b* is imparted with a tone color by the VCF 7C according to the control waveform EW1 and imparted with an amplitude envelope by the VCA 7*d* according to the control waveform EW2. The musical tone signal imparted with the tone color and the amplitude envelope in this manner is produced as a musical tone by a sound system, not shown, via a mixing resistor 8.

The timing signal generator 9 operates in synchronism with a synchronizing signal SY produced by the highest key detector 6 for producing various timing signals that control the operations of the depressed key detectors 2*a* to 2*c*, the tone production assignment section 4, the first tone production system 5 and the highest key detector 6. Thus, the timing signal generator 9 controls the basic operation sequence of the electronic musical instrument of this invention.

Having described the outline of the essential component elements of the electronic musical instrument of this invention, the detail of the construction and operation of each element will be described hereunder. As the UK, LK and PK depressed key detectors may be used those disclosed, for example, in U.S. Pat. No. 4,148,017 issued to Tomisawa on Apr. 3, 1979 and as the key code modification system 3 may be used the one disclosed in U.S. Pat. No. 4,184,401 issued to Hiyoshi et al on Jan. 22, 1980. Further, as the tone production assignment section 4 and the first tone production system 5 may be used those disclosed in U.S. Pat. No. 4,192,211 dated Mar. 11, 1980. For this reason, in the following description these elements will not be described in detail.

A Timing signal generator 9 (part 1)

Figure 2:
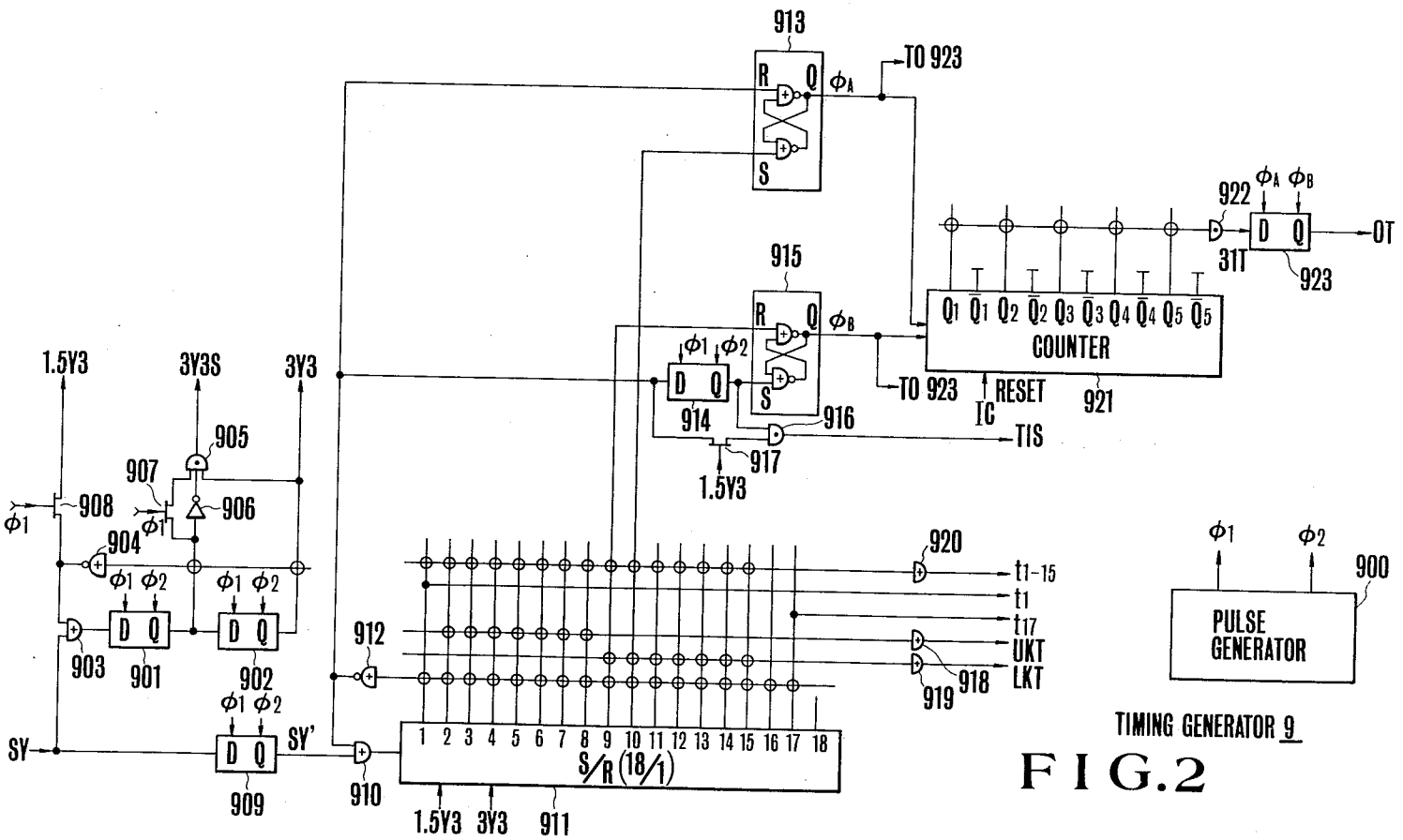
FIG. 2 is a connection diagram showing the detail of one example of a timing signal generator shown in FIG. 1.

FIG. 2 shows one example of the essential elements of the timing signal generator 9 shown in FIG. 1 in which, as above described, various timing signals control the basic operation of the electronic musical instrument. The timing signal generator 9 comprises a pulse generator 900 which generates two phase clock pulse signals $\phi$1 and $\phi$2 having opposite phases as shown at (a) and (b) in FIG. 3 and serially connected delay flip-flop circuits 901 and 902 operated by the clock signals $\phi$1 and $\phi$2. The delay flip-flop circuit 901 is supplied, through an OR gate circuit 903, with a synchronizing signal SY produced by the synchronizing data "1111" obtained in the data demultiplexer 6*a* during the first state of the first multiplex channel time of the multiplexed data MD shown in Table V. The outputs of the delay flip-flop circuits 901 and 902 are applied to a NOR gate circuit 904. When these outputs are both "0", a signal "1" is inputted to the delay flip-flop circuit 901 via the OR gate circuit 903, thus constituting a two-stage circulating shift register. Consequently, as shown at (c) in FIG. 3, when the synchronizing signal SY, synchronous with the clock signal $\phi$1 and having a pulse width equal to one period thereof, is inputted to the delay flip-flop circuit 901 via the OR gate circuit 903, the delay flip-flop circuit 901 receives the synchronizing signal SY by the timing action of the clock signal $\phi$1 to produce an output by the timing action of the clock signal $\phi$2 thereby producing a signal obtained by delaying the synchronizing signal SY by one bit time (one period of the clock signals $\phi$1 and $\phi$2), as shown by (d) in FIG. 3. This output signal (d) of the delay flip-flop circuit 901 is applied to the delay flip-flop circuit 902 to be delayed by one bit time and then outputted as shown by (e) in FIG. 3. As the output signals of the delay flip-flop circuits 901 and 902 become "0", the output signal of the NOR gate circuit 904 becomes "1" as shown by (f) in FIG. 3. The output signal "1" of the NOR gate circuit 904 is received again by the delay flip-flop circuit 901 by the timing action of the clock signal $\phi$1 to continue an operation similar to that described above. Accordingly, the delay flip-flop circuit 902 produces a signal (e) in synchronism with the synchronizing signal SY, the signal having a frequency of $\frac{1}{3}$ of that of the clock signal $\phi$1. This signal is produced as a timing signal 3Y3 showing the timing of the third state in respective multiplex channel times of the multiplex data MD shown in Table V and produced by the data multiplexer. Accordingly, by latching the multiplex data MD by using this timing signal 3Y3, it is possible to derive out the note codes N1 to N4 of the key code KC assigned to respective tone production channels.

The AND gate circuit 905 is supplied with the timing signal 3Y3 (e), a signal obtained by inverting the output signal (d) of the delay flip-flop circuit 901 with an inverter 906, and the output signal of the delay flip-flop circuit 901, which is supplied through a field effect transistor 907 turned on by the timing action of the clock signal $\phi$1. Since the output line of the field effect transistor 907 is connected to the AND gate circuit 905 having a high input impedance, the input (the output of the delay flip-flop circuit 901) applied by the timing action of the clock signal $\phi$1 is maintained by the stray capacitance of the output line until the next clock signal $\phi$1 is applied. Consequently, as shown by (g) in FIG. 3, the AND gate circuit 905 produces a timing signal 3Y3S (a signal produced by differentiating the building up portion of the timing signal 3Y3 shown in FIG. 3) which becomes "1" during one half period of the clock pulse $\phi$2 subsequent to the building up of the timing signal 3Y3. The output signal (f) of the NOR gate circuit 904 is produced through a field effect transistor 908 to render conductive by the clock signal $\phi$1. Since the output line of the transistor 908 is connected to a load (logic circuit) having a high input impedance, the input condition (the output of the NOR gate circuit 904) at the time of generating the clock signal $\phi$1 would be maintained by the stray capacitance of the output line until the next clock signal $\phi$1 is supplied. Consequently, the field effect transistor 908 produces a timing signal 1.5Y3 which is obtained by delaying the timing signal 3Y3 by 1.5 periods of the clock signal $\phi$1.

Although the timing signal generator 9 is provided with a circuit which produces other timing signals t1–15, t1, 517, UKT, LKT, OT and the above described timing signals 3Y3, 3Y3S and 1.5YS, the circuit will be described later.

B Data Demultiplexer 6*a*

Figure 5:
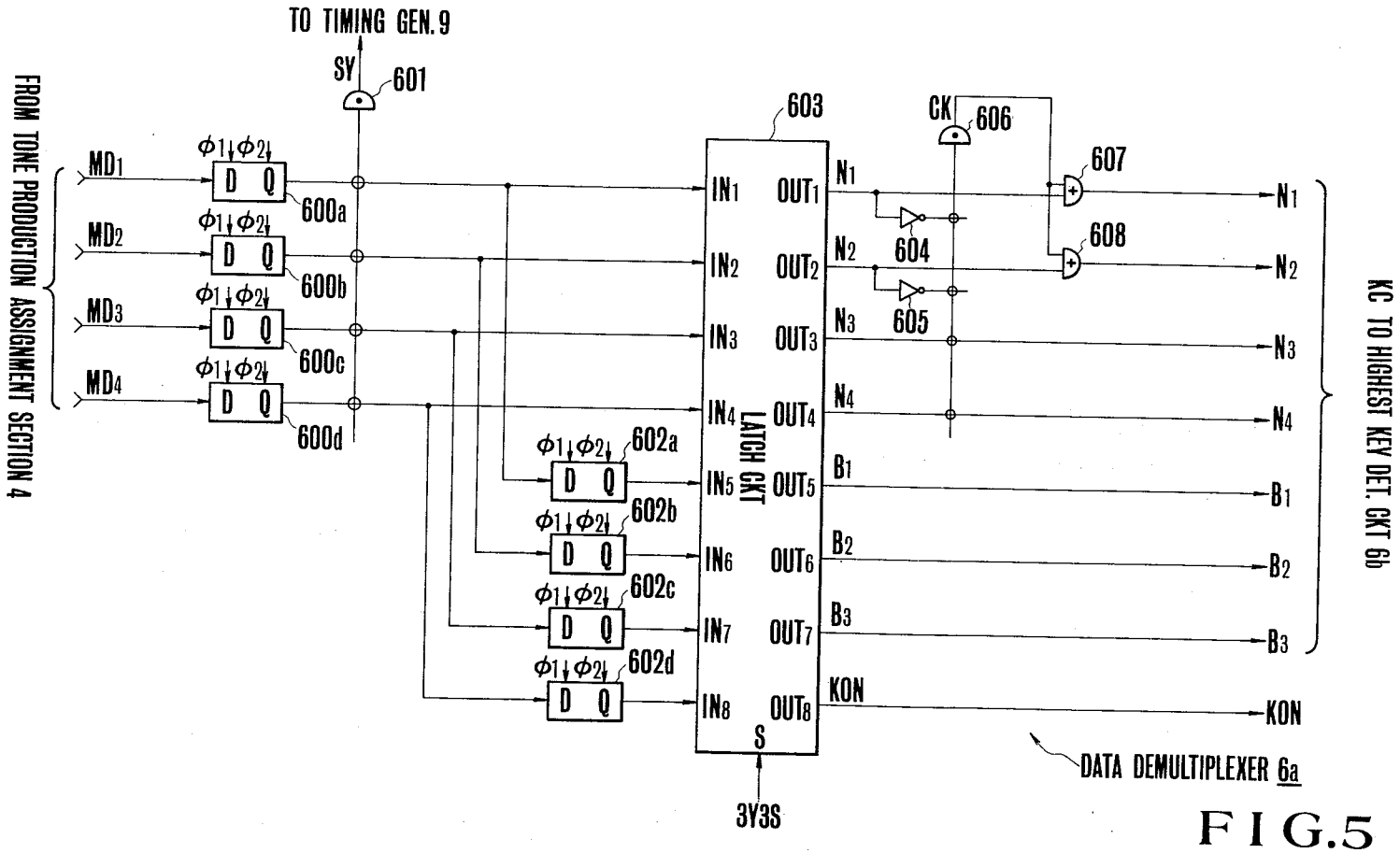
FIG. 5 is a connection diagram showing the detail of the demultiplexer shown in FIG. 1.

The detail of the data demultiplexer 6*a* shown in FIG. 1 is illustrated in FIG. 5. The 4 bit multiplexed data MD (MD1 to MD4) shown in Table V and produced by the tone production assignment circuit 4 in synchronism with the clock signal $\phi$1 are supplied to delay flip-flop circuits 600*a* to 600*d* driven by the clock signals $\phi$1 and $\phi$2 (FIG. 3) and outputted therefrom after being delayed by one bit time. Respective bit signals MD1 to MD4 of the delayed multiplexed data MD produced by respective delay flip-flop circuits 600*a* to 600*d* are applied to an AND gate circuit 601 to detect the synchronizing data "1111", and the output "1" of the AND gate circuit 601 is applied to the timing signal generator 9 shown in FIG. 2 to act as the synchronizing signal SY representing the start portion of the multiplexed data MD. Furthermore, the bit signals MD1 to MD4 of the multiplexed data MD outputted from respective flip-flop circuits 600*a* to 600*d* and applied to the input terminals IN1 to IN4 of a latch circuit 603 and also to delay flip-flop circuits 602*a* to 602*d* driven by the clock signals $\phi$1 to $\phi$2. These delay flip-flop circuits delay the bit signals MD1 to MD4 applied thereto by one bit time and then apply them to the input terminals IN5 to IN8 of the latch circuit 603.

A timing signal 3Y3S (FIG. 3) is applied to the strobe terminal S of the latch circuit 603 so as to latch the signals applied to the input terminals IN1 to IN8 at the time of generation of the timing signals 3Y3S. As has been described in detail with reference to the timing signal generator 9 shown in FIG. 2, the timing signal 3Y3S is obtained by differentiating the building up portion of the timing signal 3Y3 (FIG. 3) indicative of the timing of the third state of respective multiplex channel times. Accordingly, at the time of generation of this timing signal 3Y3S, the delay flip-flop circuits 600*a* to 600*d* produce bit signals MD1 to MD4, that is the note codes N1 to N4 at the third state of respective multiplex channel times shown in Table V, whereas the delay flip-flop circuits 602*a* to 602*d* produce the bit signals MD1 to MD4, that is the block code bits B1 to B3 and the key-on signal at the second stage of respective multiplex channel times, which are obtained by delaying one bit time the outputs of the delay flip-flop circuits 600*a* to 600*d*. Consequently, when the latch circuit 603 is operated by the timing signal 3Y3S, the note code N1 to N4, the block code B1 to B3, and the key-on signal KON are produced respectively from the output terminals OUT1 to OUT8 of the latch circuit 603. As above described, the latch circuit 603 sequentially produces in parallel the note code N1 to N4, the block code B1 to B3 and the key-on signal KON of each of the tone production channels each time the timing signal 3Y3S is generated. The interval in which a key code KC and a key-on signal regarding one tone production channel are generated from the latch circuit 603 is herein termed as a production channel time, and the relationship among the production channel times, the tone production channels (that is the outputs of the latch circuit 603) and the multiplexed channel times is shown in the following Table VI.

Inverters 604 and 605 that invert the bits N1 and N2 of the note code are provided on the output side of the latch circuit 603. An AND gate circuit 606 is enabled by the outputs (N1, N2) of the inverters 604 and 605 and the bits N3 and N4 of the note code outputted from the latch circuit 603 to detect the note codes N4 to N1 of the note C shown in Table III so as to produce a C note detection signal CK. When the AND gate circuit 606 produces the C note detection signal CK, the output of an OR gate circuit 608 supplied with the signal CK becomes 1 thereby converting the note codes N4 to N1 ("1100") of the note C shown in Table III into "1111".

TABLE VI

| | | | | | | | | | | | | | | | | | | |
|---|---|---|---|---|---|---|---|---|---|---|---|---|---|---|---|---|---|---|
| production channel time | 1 | 2 | 3 | 4 | 5 | 6 | 7 | 8 | 9 | 10 | 11 | 12 | 13 | 14 | 15 | 16 | 17 | 18 |
| output of latch circuit 603: | 1 | 4 | 7 | 10 | 13 | 16 | 2 | 5 | 8 | 11 | 14 | 17 | 3 | 6 | 9 | | | |
| tone production channel | (PK) | (UK) | (UK) | (UK) | (UK) | (UK) | (UK) | (UK) | (LK) | (LK) | (LK) | (LK) | (LK) | (LK) | (LK) | | | |
| multiplex channel time | 1 | 2 | 3 | 4 | 5 | 6 | 7 | 8 | 9 | 10 | 11 | 12 | 13 | 14 | 15 | 16 | 17 | 18 | 1 |
| state | 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 | 1 2 3 |

C Timing Signal Generator (part 2)

Turning back to FIG. 2, the remaining portion of the timing signal generator 9 will now be described. The synchronizing signal SY generated by the data demultiplexer 6*a* is delayed by one bit time (one period of the clock signal $\phi$1) by a delay flip-flop circuit 909 actuated by the clock pulses $\phi$1 and $\phi$2 and thereafter applied via an OR gate circuit 910 to a shift register 911 having 18 stages of the same number as that of the tone production channels. The shift register 911 is supplied with an input signal by the timing action of the timing signal 1.5Y3 described above (FIG. 3) thus shifting its content according to the timing signal 3Y3 (FIG. 3). For the purpose of coinciding the timing signal 1.5Y3, which takes in the input to the shift register 911 with its input signal, the synchronizing signal SY is delayed by one bit time by the delay flip-flop circuit 909 and the delayed synchronizing signal SY′ is applied to the shift register 911 via the OR gate circuit 910. The shift register 911 receives the synchronizing signal SY′ ("1") according to the timing signal 1.5Y3 to sequentially shift the signal "1" (SY′) applied to the timing signal 3Y3 (FIG. 3). More particularly, the first stage of the shift register 311 produces a signal "1" during an interval between the generation of the first timing signal 3Y3 immediately after generation of the synchronizing signal SY (i.e. the third state of the first multiplex channel time) and an instant immediately before the generation of the second multiplex channel time (i.e., the second state of the second multiplex channel time). Upon generation of the second timing signal 3Y3, this signal "1" is shifted to the second stage which produces a signal "1" during an interval between the generation of the second timing signal 3Y3 and an instant immediately before the generation of the third timing signal 3Y3.

In the same manner as above described, when the timing signal 3Y3 is generated the signal "1" is sequentially shifted from the second stage to the 18th stage of the shift register. Thus, the outputs of respective stages of the shift register 911 represent the first to 18th channel times shown in Table VI. When the signal "1" is shifted to the 18th stage of the shift register 911, a NOR gate circuit inputted with the outputs of the first to 17th stages of the shift register 911, produces an output "1" which is applied to the input terminal of the shift register 911 via an OR gate circuit 910 thereby constituting a circulation type shift register. When the signal "1" inputted to the shift register 911 is sequentially shifted to the 10th stage and a signal "1" is produced therefrom, the flip-flop circuit 913 is set to produce a Q output of "1". When the inputted signal is further shifted until the output of the 18th stage becomes "1", the output of the NOR gate circuit 912 becomes "1" to reset the flip-flop circuit 913 producing a Q output of "0". The signal "1" outputted by the NOR gate circuit 912 when the signal "1" inputted to the shift register has been shifted to the 18th stage is delayed by one bit time by the delay flip-flop circuit 914 and then utilized to set a flip-flop circuit 915 to cause its Q output to become "1". When the output of the 9th stage of the shift register 911 becomes "1", the flip-flop circuit 915 is reset so that its Q output becomes "0". Consequently, the output Q of the flip-flop circuit 913 becomes "1" during an interval in which either one of the outputs of the 10th to 17th stages of the shift register 911 becomes "1", as shown by a clock signal $\phi$A, labeled (a) in FIG. 4. The output Q of the flip-flop circuit 915 becomes "1" during an interval in which either one of the outputs of the first to 8th stages of the shift register 911 becomes "1" as shown by a clock signal $\phi$B, labeled (b) in FIG. 4. The inputs of an AND gate circuit 916 is supplied with the output signal of a delay flip-flop circuit 914, and the output of the NOR gate circuit 912 supplied through a field effect transistor 917 which is rendered on when the timing signal 1.5Y3 is generated. Since the output line of the transistor 917 is connected to one input of the AND gate circuit 916 having a high input impedance, the input condition (i.e. the output of the NOR gate circuit 912) at the time of generation of the AND gate circuit 916 is held continuously by the stray capacitance of the output line until the next timing signal 1.5Y3 is generated with the result that the output signal of the AND gate circuit 916 becomes "1" during the fore half of the period of generation of the output of the first stage of the shift register 911 as shown by a timing signal TIS, labeled (c) in FIG. 4, thus showing the building up portion of the first channel. As shown at (d) in FIG. 4, the first stage output of the shift register 911 is outputted as a timing signal t1 indicative of the first multiplex channel time (corresponding to the tone production channel for the pedal keyboard) shown in Table VI, while the outputs of the second to the 8th stages of the shift register 911 are produced through an OR gate circuit 918 as a timing signal UKT representing the second to the 8th channel times (corresponding to the tone production channels of the upper keyboard) as shown at (e) in FIG. 4. As shown at (f) in FIG. 4, the outputs of the 9th to 15th stages of the shift register 911 are outputted as a timing signal LKT showing the 9th to 15 channel times (corresponding to the tone production channels for the lower keyboard). Further, the 17th stage output of the shift register 911 is outputted as a timing signal t17 representing the 17th channel time as shown at (g) in FIG. 4. The outputs of the first to 15th stages of the shift register 911 are outputted through an OR gate circuit 920 as timing signals t1 to t15 shown at (h) in FIG. 4, and are indicative of the first to 15th channel times.

A counter of the binary 5 digit construction, which is reset by an initial clear signal IC generated at the time of closing a power switch, sequentially counts up the clock signals $\phi$A and $\phi$B produced by flip-flop circuits 913 and 915 respectively.

As a consequence, the shift register 921 counts up one during each one period of the shift register 911, in other words, each time the first to 18 channel times shown in Table VI circulate once. On the output side of the counter 921 is provided an AND gate circuit 920 which produces a timing signal 31T each time the count of the counter 921 reaches decimal 31. The timing signal 31T produced by this AND gate circuit 922 is delayed by one count time of the counter 921 (an interval corresponding to one period of the shift register 911) by a delay flip-flop circuit 922 driven by the clock signals $\phi$A and $\phi$B and then outputted as a timing signal OT.

D The Highest Key Detector *6b*

Figure 3:
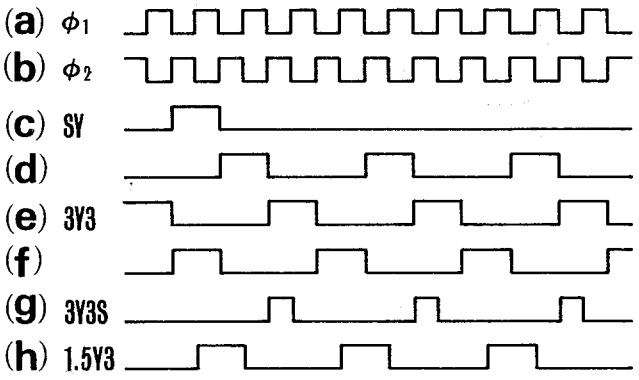
FIGS. 3 and 4 show waveforms at various portions useful to explain the operation of the timing signal generator shown in FIG. 2.
Figure 4:
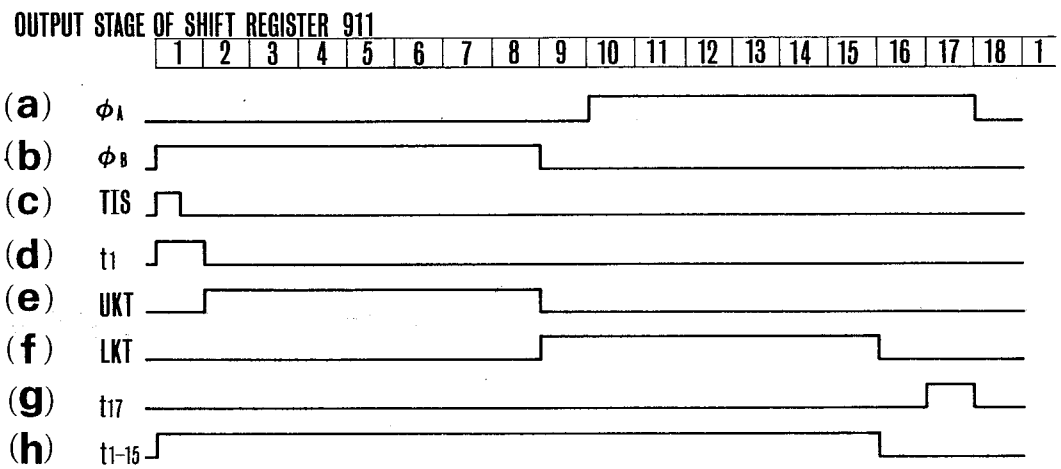
Figure 6:
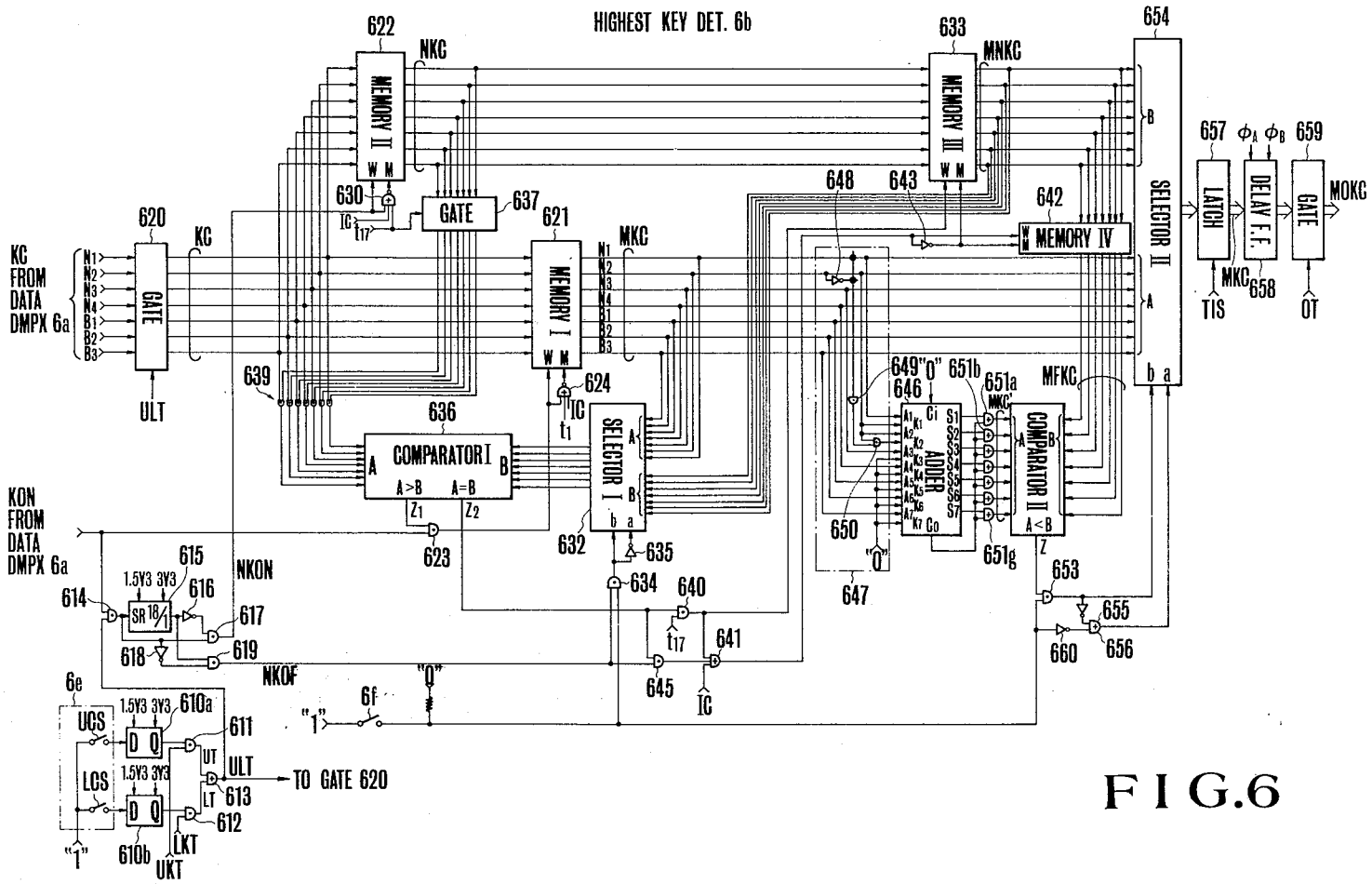
FIG. 6 is a connection diagram showing the detail of one example of a highest key detector shown in FIG. 1.

FIG. 6 shows the detail of the highest key detector *6f* shown in FIG. 1 in which the output signals of the UK selection switch UCS and the LK selection switch LCS of the keyboard selection switch group *6e* are applied to delay flip-flop circuits 610*a* and 610*b* respectively by the timing action of the timing signal 1.5Y3 (FIG. 39 and thereafter outputted according to the timing signal 3Y3 (FIG. 3). This is done for the purpose of preventing the chattering of the selection switches UCS and LCS from affecting succeeding circuits. The output signal of the delay flip-flop circuit 610*a* is applied to an AND gate circuit 611 together with the timing signal UKT (FIG. 4) produced by the timing signal generator 9 shown in FIG. 2. Thus, the AND gate circuit 611 produces a UK selecting signal UT which becomes "1" only during an interval of generating the timing signal representing an interval (the second to the 8th channel times) in which the data (key code UKC and the key-on signal KON) regarding the tone production channels for the upper keyboard are sent out from the latch circuit 603 (FIG. 5) when the UK selection switch UCS is closed. The output signal of the delay flip-flop circuit 610*b* is applied to an AND gate circuit 612 together with the timing signal LKT (FIG. 4*f*). The AND gate circuit 612 produces an LK selection signal LT which becomes "1" only in an interval in which the timing signal LKT, representing an interval (the 9th to the 15th channel times) in which data (a key code LKC and a key-on signal) regarding the tone production channel for the lower keyboard are sent out from the latch circuit 603 when a LK selection switch LCS, is closed. The UK selection signal UT and the LK selection signal LT produced by the AND gate circuits 611 and 612 are outputted via an OR gate circuit 613 to act as a ULK selection signal ULT.

The key-on signal KON, sent from the data demultiplexer *6a* (FIG. 5), and the ULK, selection signal ULT outputted from the OR gate circuit 613, are applied to the inputs of an AND gate circuit 614 so that only the key-on signal KON of the tone production channel, corresponding to a keyboard selected by the UK and LK selection switches UCS and LCS, is supplied to a shift register 615 through this AND gate circuit 614. The shift register 615 is of the 18-stage/1-bit type having the same number of stages as the number of tone production channels (in this example, 18 stages). It receives the output signal of the AND gate circuit 614 according to the timing signal 1.5Y3 (FIG. 3) sent from the timing signal generator 9 (FIG. 2) for shifting the inputted signal according to the timing signal 3Y3 (FIG. 3). Consequently, to the shift register 615 is inputted a key-on signal KON ("1") during a production channel time (see Table VI) corresponding to a tone production channel assigned with the key code KC of a depressed key of a keyboard designated by the keyboard selection switch group 6e and the inputted key-on signal KON is sequentially shifted to produce it after delaying the same by 18 channel times. After being inverted by an inverter 616, the output signal of the shift register 615 is applied to the AND gate circuit 617 together with the output signal of the AND gate circuit 614. When the key-on signal produced by the AND gate circuit 614 is "1", and the key-on signal produced by the AND gate circuit 614 in a channel time one period before is "0", the AND gate circuit 617 produce a new key-on signal NKON ("1") showing that a new key code KC of a depressed key has been assigned to the tone production channel corresponding to the given channel time. The key-on signal produced by the shift register 615 and the output of an inverter 615 which inverts the key-on signal produced by the AND gate circuit 614 are applied to an AND gate circuit 619. Where the key-on signal produced by the AND gate circuit 614 is "0" and the key-on signal of the given channel time produced by the shift register 615 one period before is "1", the AND gate circuit 619 produces a new key-off signal NKOF which shows that the key regarding a key code assigned to the tone production channel corresponding to the channel time has been newly released. As above described, since the tone production assignment section 4 performs only once the assigning operation (depressed key processing or released key processing) during the first to the 18th multiplex channel times, the key-on signal KON produced by the latch circuit 603 (FIG. 5) changes from "0" to "1" or vice versa during only one channel time of the first to 18th channel times. Thus, the new key-on signal NKON or the new key-off signal NKOF is produced only once in a single channel time among the first to the 18th production channel times. Of course, where there is no newly depressed or released key, signals NKON and NKOF are not produced.

Figure 7:
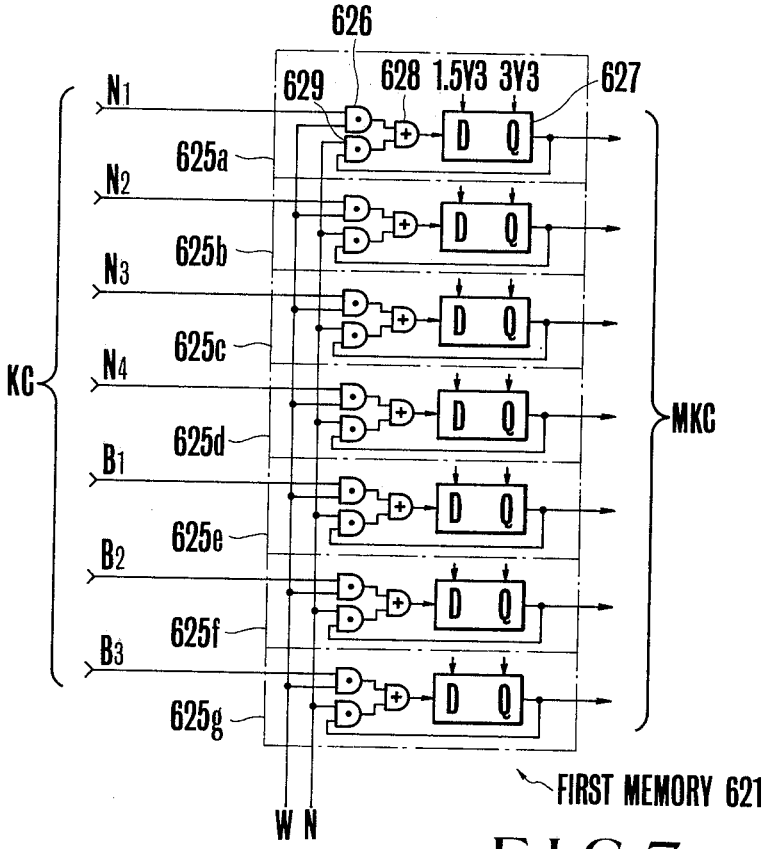
FIG. 7 is a connection diagram showing one example of the first through fourth memory devices shown in FIG. 6.

The key codes KC (block code bits B3 to B1 and the note code bits N4 to N1) produced by the data demultiplexer 6a are applied respectively to the first and second memory devices 621 and 622 via a gate circuit 620 enabled by the ULK selection signal ULT produced by the OR gate circuit 613. The gate circuit 620 is provided for the purpose of deriving out only a key code of a keyboard selected by the UK and LK selection switches UCS and LKS and functions similar to the aforementioned AND gate circuit 614. The first memory device 621 is written with an input key code KC by utilizing a signal "1" produced by an AND gate circuit 623, to be described later as a write signal W, and a signal "1" outputted from a NOR gate circuit 624 supplied with the output of the AND gate circuit 603, the timing signal t1 (FIG. 4d) and the initial clear signal IC, is used as a holding signal M. As shown in FIG. 7, the first memory device 621 comprises, for example, registers 625a to 625g respectively applied with the note codes N1 to N4 and the block codes B1 to B3 respectively. Each one of the registers 625a and 625g is constituted by an AND gate circuit 626 enabled by the write signal W for inputting an input signal, an OR gate circuit 628 for applying the output signal of the AND gate circuit 626 to the delay flip-flop circuit 627, and an AND gate circuit 629 which is enabled by the holding signal M for feeding back the output of the delay flip-flop circuit 628 to the input thereof via an OR gate circuit 628 to store and continuously output the input signal. The delay flip-flop circuit 627 is supplied with the input signal by the timing signal 1.5Y3 (FIG. 3) and sends out an output signal according to the timing signal 3Y3 (FIG. 3e) so that respective registers 625a to 625g produce outputs in synchronism with respective production channel times (Table VI).

Also the second memory device 622 in constructed similar to the first memory device 621 shown in FIG. 7, and utilizes the new key-on signal NKON produced by the AND gate circuit 617 as a write signal W and the output signal "1", as a write signal, of the NOR gate circuit 630 connected to receive the new key-on signal NKON, the initial clear signal IC and the timing signal t17 (FIG. 4d). As above described, since the new key-on signal NKON is produced only once during the first to the 18th production channel times, a single key code KC synchronous with the new key-on signal NKON produced by the AND gate circuit 617 among the key codes KC inputted during the second to the 15th production channel times, that is only the new key code NKC (the key code of a newly depressed key) is stored in the second memory device 622 and the stored data is held continuously until the memory device is reset by the generation of the next timing signal t17 (at (g) in FIG. 4).

To the input A of the selector 632 is applied a highest key code MKC outputted from the first memory device 621. To the input B is applied a highest key new-key-code MNKC produced by the third memory device 633 to be described later. When a signal "1" is supplied to a selection terminal, the highest key code MKC of the first memory device 621 inputted to the input A is selected and outputted, whereas when a signal "1" is supplied to a selection terminal b, the highest key new-key-code MNKC supplied to the input B is selected and outputted. At this time, the output of the AND gate circuit 634 inputted with the new key-off signal NKOF and the output of the tone production control switch 6f is applied to the selection input b of the first selector 632; whereas to the selection input a, the output of the inverter 635, which inverts the output of the AND gate circuit 634, is applied. Accordingly, the first selector 632 produces the highest key new key-code MNKC which has been applied to the input B only when a new key-off signal NKOF is generated in a state in which the tone production control switch 6f is closed, and produces in the other states in which the highest key key-code MKC is inputted to the input A.

The output of the gate circuit 637 supplied with the output (key code KC) of the gate circuit 620 or the output (new key code NKC) of the second memory device 622 is applied to the input A of the comparator 636 via the OR gate circuit group 639 while an output selected by the first selector 632 is applied to the input B. Where the signals inputted to the A and B inputs has a relation of $A>B$, a signal "1" is supplied to an AND gate circuit 623 from an output Z1 of the first comparator 636, whereas when $A=B$, a signal "1" is supplied to an AND gate 640 from the output terminal Z2 of the comparator 636. Under the normal mode in which the tone production control switch 6f is open the output signal of the AND gate circuit 634 is always "0" so that signal "1" normally applied to the selection terminal b of the first selector 632. Accordingly, the comparator 636 compares the output key code C supplied thereto via the OR gate group 63 with the output key code MKC of the first memory device 621 supplied to the comparator 636 via the first selector 632 during the second to the 15th production channel times.

At this time, the first memory device 621 is reset by the initial clear signal IC and reset by the timing signal t1 (FIG. 4) which becomes "1" in the first channel time, so that when a key code KC is produced from the gate circuit 620 during the second channel time, a relationship A>B holds with the result that the comparator 636 applies a signal "1" to the AND gate circuit 623 from the output terminal Z1. The AND gate circuit 623 is enabled by signal "1" supplied from the comparator 636 and the key-on signal KON to supply its output signal acting as the write signal W to the first memory device 621 only when a key regarding the key code KC is in the depressed condition. Since the write signal W is "1", the first memory device 621 is written with and stores the key code KC produced by the gate circuit 620. In the next third channel time, the first memory device 621 produces the key code KC which has been written in the second channel time, and the key code KC is applied to the input B of the comparator 636. Then, the comparator compares the key code KC produced by the gate circuit 620 with the key code KC produced by the first memory device 621, and when a condition A>B is satisfied the comparator 636 produces a write signal W in the same manner as above described to newly write the output key code KC into the first memory device 621. When the condition of A>B is not satified, the output key code KC of the first memory device 621 is stored continuously. Similar operations are executed in each one of the second to the 15th production channel times, so that at the end of the 15th channel time, a key code having the highest tone pitch (the maximum value) among the key codes corresponding to the depressed keys of a keyboard designated by the keyboard selection group **6*e* is held in the first memory device 621. This highest pitch key code MKC is held until a next timing signal t1 (FIG. 4*a*) is generated synchronously with the first production channel time and then cleared when the timing signal t1** is generated.

Upon generation of the timing signal t17, the new key code NKC which has been stored in the second memory device 622 is supplied to the input A of the comparator 636 via the gate circuit 637 enabled by the timing signal t17 and through the OR gate circuit group 639. Consequently, at the time of generation of the timing signal t17 the comparator 636 compares the new key code NKC with the highest key key-code MKC held in the first memory device 621, and when a coincidence is obtained, the comparator 636 supplies from its output terminal Z2 to the AND gate circuit 640 a signal "1" as a maximum or the highest tone key code MKC among the respective key code KC during the second to the 15th production channel times. At this time, since the AND gate circuit 640 is enabled by the timing signal t17 (FIG. 4) it produces an output signal "1" which is supplied not only to the third memory device 633 as a write signal W but also to the fourth memory device 642 also as a write signal W via the OR gate circuit 641. The output signal "1" of the OR gate circuit 641 is inverted by the inverter 643 to become a signal "0" whereby the holding signals M for the third and fourth memory devices 633 and the 642 become "0". Consequently, as a signal "1" is produced by the output terminal Z2 of the comparator 636, that is when the new key code NKC is judged as the highest tone pitch code, the contents of the third and fourth memory devices 623 and 642 are reset, while in the third memory device 633 is written the new key code NKC produced by the second memory device 622 as the highest tone pitch key code KC. Further, the output of the third memory device 633 is written into the fourth memory device 642.

When the tone production switch **6*f* is closed to establish the "tone production mode", in the same manner as the above described "normal mode", the writing and the memory holding operations are performed for the first to the fourth memory devices 621, 622, 633 and 642. However, in the "tone production control mode" the following additional operations are also executed. More particularly, when the AND gate 619 produces a new key-on signal NKON during the second to the 15th production channel times, the output signal of the AND gate circuit 634 becomes "1" with the result that the first selector 632 selects the input terminal B during these channel times to supply to the input B of the comparator 636 the new key code held in the third memory device 633 that is the highest tone new key code MNKC. In these channel times, the comparator 636 compares the key code KC supplied to its input A from the gate circuit 620 during these channel times with the highest key new-key-code MNKC supplied to its B input, and when these inputs coincide with each other the comparator 636 produces a signal "1" from its output terminal Z2. In the channel time in which the new-key-off signal NKOF is generated, as the gate circuit 620 produces the key code KC of the newly released key, the output terminal Z2 of the comparator 636** produces a signal "1" meaning that the released key is the highest key new-key-code MNKC. In other words, whether the newly released key corresponds to the highest key new-key-code MNKC or not is judged.

During the "normal mode", the output of the inverter 660, which inverts the output signal "0" of the tone production control switch **6*f* is supplied to a selection terminal "a" of the second selector 654 via the OR gate circuit 656. The highest key key-code MKC produced by the first memory device 621 is supplied to the input A of the second selector 654, while to the input B is applied the highest key new-key-code MNKC produced by the third memory device 633. In the same manner as the first selector 632, when the signal "1" is applied to the selection terminal "a", the second selector 654 selects the input terminal A when signal "1" is applied to the selection terminal "a", whereas when the signal "1" is supplied to its selection terminal b, it selects the input terminal B. Consequently, the highest key key-code MKC produced by the first memory device 621 is always supplied to the latch circuit 657 via the second selector 654**.

As above described, when a key related to the key codes KC assigned to respective tone production channels is released the key-on signal KON of a tone production channel assigned with the key code of the released key becomes "0" but since this key code KC is continuously outputted until the key code of the newly depressed key is assigned to the tone production channel, it does not interfere with the comparing operation of the comparator 636 in which the key code KC outputted from the gate circuit 620 following the release of the key and the highest key new-key-code MNKC outputted from the third memory device 633 are compared with each other. At this time, since the key-on signal KON is "0" the AND gate circuit 623 is disabled so that the write signal W for the first memory device 621 is not generated.

The signal "1" produced from the output terminal Z2 of the comparator 636 and the new-key-off signal NKOF produced by the AND gate circuit 619 are applied to the inputs of an AND gate circuit 645 and when these inputs coincide with each other, in other words, when the newly released key is of the highest key new-key-code MNKC, the AND gate circuit 645 produces an output signal "1". As above described, the timing of generation of the signal "1" from the output terminal Z2 of the comparator 636 corresponds to either one of the second to the 15th production channel times and does not coincide with the timing signal t17 so that the AND gate circuit 648 does not produce the signal "1". The output signal "1" of the AND gate circuit 645 is supplied not only to the fourth memory device 642 via an OR gate circuit 641 to act as a write signal A but also to the third and fourth memory devices 633 and 642 to act as a holding signal M of the signal "0". As a consequence, when a signal "1" is produced by the AND gate circuit 645, i.e., when a key of the highest key new-key-code MNKC is released, the highest key new-key-code MNKC stored in the third memory device 633 is transferred to the fourth memory device 642, thus clearing the third memory device 633. As a consequence, the fourth memory device 642 holds the highest key new-key-code MNKC of the released key as the highest key off-key-code MFKC. In this regard, when the output signal of the output terminal Z2 of the comparator 363 is "0" in a channel time in which the new-key-off signal NKOF is generated, when the newly released key does not correspond to the highest key new-key-code MNKC, the output of the AND gate circuit 645 also becomes "0" so that the contents of the third and fourth memory devices 633 and 642 is not varied.

Thus, in the "tone production control mode", the first memory device 621 continues to hold and output the highest key key-code MKC among the key codes KC of a keyboard designated by the ULK selection signal ULT during the second to the 15th production channel times until the start of the next second to the 15th production channel times, while the second memory device 622 continues to hold and output the new-key-code NKC supplied during the second to the 15th production channel times until the termination of the 17th production channel time (the time when the timing signal t17 (FIG. 4*g*) is generated). Where the new-key-code stored in the second memory device 622 during the 17th production channel time corresponds to the highest key key-code MKC stored in the first memory device 621, the third memory device 633 continues to hold this new-key-code NKC as the highest key new-key-code MNKC until a new-key-code NKC of the higher tone pitch is supplied or until the key corresponding to the new-key-code NKC is released. Thus, when a key corresponding to the highest key new-key-code MNKC stored in the third memory device 623 is released, the fourth memory device 642 stores the key code MNKC as the highest key off-key-code MFKC.

Under these conditions, even when the fourth memory device 642 is supplied with a new-key-code NKC of a pitch higher than the highest key new-key-code MNKC now being stored in the third memory device 633, the fourth memory device stores the mentioned highest key new-key-code MNKC. This is caused by decreasing the number of wirings by utilizing the memory holding signal M for the third memory device 633 as the write signal W for the fourth memory device 642 so that there is no appreciable difference in the operation.

To this end the comparator 636 sequentially compares the key code KC supplied thereto via the OR gate circuit 620 during the second to the 15th production channel times with the highest key key-code MKC of the first memory device supplied through the first selector 632 thus leaving the maximum value key code KC (the highest key-code KC) in the first memory device 621. On the other hand, in the 17th production channel time, the comparator 636 compares the new-key-code NKC held in the second memory device 622 with the highest key key-code MKC of the largest value held in the first memory device 671 during the second to the 15th production channel times to judge whether the new-key code NKC is the highest key key-code MKC or not.

Where a new-key-off code NKOF is generated in any one of the second to the 15th production channel times, the comparator 636 compares the key code KC of the released key with the highest key new-key-code MNKC to judge whether the key of the highest key new-key-code MNKC has been released or not.

An adder 646 is provided to add signals inputted to its input terminals A1 to A7 to the input signals supplied to its input terminals K1 to K7 to produce their sums at the output terminals S1 to S7 and a carry signal at its output terminal C0. To the input terminals A1 to A7 are applied the note code bits N1 to N4 and the block code bits B1 to B4 of the highest key key-code MKC produced by the first memory device 621 whereas to the input terminals K1 to K7 are supplied the outputs of an adding value generator 647 which generates the values to be added necessary to obtain a modified highest key key-code MKC′ (note code N1′ to N4′ and block code B1′ to B3′) having a higher pitch than the highest key key-code MKC produced by the first memory device 621 by a predetermined number of keys (in the example, 2 keys, that is 200 cents). In this case, where a key code KC′ having a tone pitch higher than a given key code KC by 200 cents corresponding to two keys (semitones) is to be produced, mere addition of a predetermined value corresonding to 200 cents to a certain key code KC, would cause trouble. As shown in Table III, the values of the note codes NC (N4 to N1) are not assigned to the notes C# to C under an equal condition (provided that the note C has been demodulated to "1111"). More particularly, the differences between the notes C# and D; D and D#; E and F; F and F#; G and G#; G# and A; A# and B; and B and C are all "1" whereas the differences in the values of the note codes NC between the notes D# and E; F# and G; A and A# and C and C# are all "2". For this reason, the note which is higher than the note C# (or E, G or A#) by 200 cents is the note D# (or F#, A or C). In this case, when "2" is added to the value of the note code NC of note C# (or E, G or A#), the note code NC of the note D# (or F#, A or C) can be produced, whereas in the case of the note D (or D#, F, F#, G#, A, B or C) the note code NC of the note E (or F, G, G#, A#, B, C#, or D) 200 cents higher can not be obtained unless "3" is added. As is well known in the art, the frequency ratio (pitch difference) between respective notes is 100 cents.

Accordingly, in order to obtain a modified highest key key-code MKC higher by 200 cents (two keys), it is necessary change to the addend produced by the adding value generator 647 to be added and applied to the input terminals A1 to A7 of the adder 646 to be "2" to "3"

according to the note of the key codes. The purpose of the adding value generator 647 is to perform such processings. Noting the bit N2 of the note code NC shown in Table III, when the bit N2 is "0", that is for C#, E, G or A#, "2" should be added, whereas when the bit N2 is "1" (D, D#, F, F#, G#, A, B or C) "3" should be added. The adding value generator 647 comprises an AND gate circuit 649 that applies the output of an inverter 648 which inverts the bit N2 of the highest key key-code MKC produced by the first memory device 621 and the bit N1, and by applying the output signal of the AND gate circuit 649 to the input terminal K2 of the adder 646 via an OR gate circuit 650 the addend is set to "2". The reason for applying the bit N1 to the AND gate circuit 649 is to prevent to send out the addend "2" when the highest key key-code MKC produced by the first memory device 621 is zero. Further, the adding value generator 647 is used to set the adding value to "3" by applying the bit N2 of the highest key key-code MKC produced by the first memory device 621 to the input terminal K1 of the adder 646 and to the input terminal K2 thereof via the OR gate circuit 650. Accordingly, by adding the highest key key-code MKC produced by the first memory device 621 to the output of the adding value generator 647, the adder 646 produces a key code 200 cents higher than the highest key key-code MKC produced by the first memory device 621 and applies the key code thus produced by the output terminals S1 to S7 to an comparator 652 to act as the modified highest key key-code MKC' respectively through OR gate circuits 651*a* to 651*g*. Where the output terminal C0 of the adder 646 produces a carry signal of "1", a problem of the modified highest key key-code MKC' inadvertently becoming a small value can be prevented by supplying the carry signal to respective OR gate circuits 651*a* to 651*g*.

The comparator 652 compares the modified highest key key-code MKC' applied to the input terminal A thereof with the highest key off-key-code MFKC applied to its input terminal B for producing a signal "1" from its output terminal Z only when A<B. Thus, the comparator 652 produces the signal "1" from its output terminal Z only when the highest key key-code MKC produced by the first memory device 621 is more than 300 cents lower than the highest key key-off-code MFKC of the highest tone pitch previously produced by the fourth memory device 642 is detected, whereas the comparator 652 produces a signal "0" from its output terminal Z when the key-code MKC is not lower by more than 300 cents. Accordingly, when the signal "1" is produced from the output terminal Z of the comparator 652, it can be noted that the highest key key-code MKC produced by the first memory device 621 has a tone pitch obtained by shifting toward the lower tone side by more than a predetermined interval (in this embodiment 300 cents) with respect to the highest key new-key-code MNKC of a previously released key. When the tone production control switch 6*f* is closed to establish the "tone production control mode", the output signal of the AND gate circuit 653 becomes "1" upon generation of the output signal "1" at the output terminal Z of the comparator 652. As a consequence, the second selector 654 selects and outputs the highest key new-key-code MNKC produced by the third memory device 633 and supplied to the input terminal B. Under these conditions, since the content of the third memory device 633 is cleared as above described, when the key corresponding to the highest key new-key-code MNKC is released, the outputs of the second selector 654 become all zero so as to prevent the generation of the musical tone signal from the second musical tone generator 7 (see FIG. 1) as will be described later, thus preventing the generation of a unnatural musical progression caused by a large shift of the tone pitch with respect to the previously generated tone.

When the output terminal Z of the comparator 652 produces a signal "0" the output of the AND gate circuit 653 becomes "0" so that the output of the inverter 655 becomes "1". Then, the second selector 654 selects and outputs the highest key key-code MKC produced by the first memory device 621 and applied to the input terminal A.

At this time, when the new-key-code NKC is the highest key key-code MKC, the code NKC is stored in the third memory device 633, with the result that the highest key key-code MKC inputted to the input terminal A of the second selector 654 becomes equal to the highest key new-key-code MNKC applied to the input terminal B. For this reason, the same key code as the new-key-code NKC will be outputted from the second selector 654 irrespective of the content of the output signal at the output terminal Z of the comparator 652.

As above described, in the "normal mode" or the "tone production control mode", the code MKC or the highest key new-key-code MNKC produced by the second selector 654 is latched by a latch circuit 657 by a timing signal generated in synchronism with the building up of the first production channel time. The highest key key-code MKC (or MNKC) latched by the latch circuit 657 is applied to a delay flip-flop circuit 658 driven by the clock pulse $\phi$A and $\phi$B (see FIGS. 4 and 6) and then outputted therefrom after being delayed by one period of the first to the 18th channel times. The output of the delay flip-flop circuit 658 is derived out as a highest tone producing key code MOKC via gate circuit enabled by a timing signal OT generated by the timing signal generator 9 shown in FIG. 2 and then supplied to the key code memory device 6*c*.

The foregoing description relating to the construction and operation of the highest key detector 6*b*, one example of the operation is shown in the following Table VII together with the contents of the first to the fourth memory devices in the "tone production mode" and the content of the highest tone producing key code MOKC with respect to a progression of the key depressions. The Table VII shows respective data at the time of generation of the timing signal t17.

TABLE VII

| sequence | note name of depressed key | newly depressed key (NKON) | newly released key (NKOF) | first memory (621) | second memory (622) | third memory (633) | fourth memory (642) | highest tone producing key code (MOKC) |
|---|---|---|---|---|---|---|---|---|
| T0 | — | | | — | — | — | — | — |
| T1 | D4 | D4 | | D4 | D4 | D4 | — | D4 |
| T2 | D4, F4 | F4 | | F4 | F4 | F4 | D4 | F4 |
| T3 | D4, F4, G4 | G4 | | G4 | G4 | G4 | F4 | G4 |
| T4 | D4, F4, G4, A4 | A4 | | A4 | A4 | A4 | G4 | A4 |

TABLE VII-continued

| sequence | note name of depressed key | newly depressed key (NKON) | newly released key (NKOF) | first memory (621) | second memory (622) | third memory (633) | fourth memory (642) | highest tone producing key code (MOKC) |
|---|---|---|---|---|---|---|---|---|
| T5 | D4, F4, G4 | | A4 | G4 | — | — | A4 | G4 |
| T6 | D4, F4 | | G4 | F4 | — | — | A4 | — |
| T7 | D4 | | F4 | D4 | — | — | A4 | — |
| T8 | D4, F4 | F4 | | F4 | F4 | F4 | — | F4 |
| T9 | F4 | | D4 | F4 | — | F4 | — | F4 |
| T10 | C#4, F4 | C#4 | | F4 | C#4 | F4 | — | F4 |
| T11 | C#4 | | F4 | C#4 | — | — | F4 | — |
| T12 | | | C#4 | — | — | — | F4 | — |

As Table VII clearly shows, the highest key detector 6b operates as follows: (1) Where the detected highest one is the new-key-code NKC (that is the highest key new-key-code MNKC), the detected key code is straight forwardly outputted as the highest tone producing key code MOKC. (2) Where the key corresponding to the highest key new-key-code MNKC is released, a judgement is made as to whether the next new highest key key-code MKC is lower from the just released highest key new-key-code MNKC by more than 200 cents or not. If the decrement is equal to or less than 200 cents, the new highest key key-code MKC is produced as the highest tone producing key code MOKC, but on the other hand, when the decrement is larger than 200 cents, the new highest key key-code MKC is prevented from being delivered. (3) When the key corresponding to the new highest key key-code MKC is released under the state following above judgment (2), a judgment is made as to whether the next new detected highest key key-code MKC is lower from the highest key new-key-code MNKC by more than 200 cents or not, thereby performing the same processing as (2).

E Key Code Memory Device 6c and The Key-on Detector 6d

Figure 8:
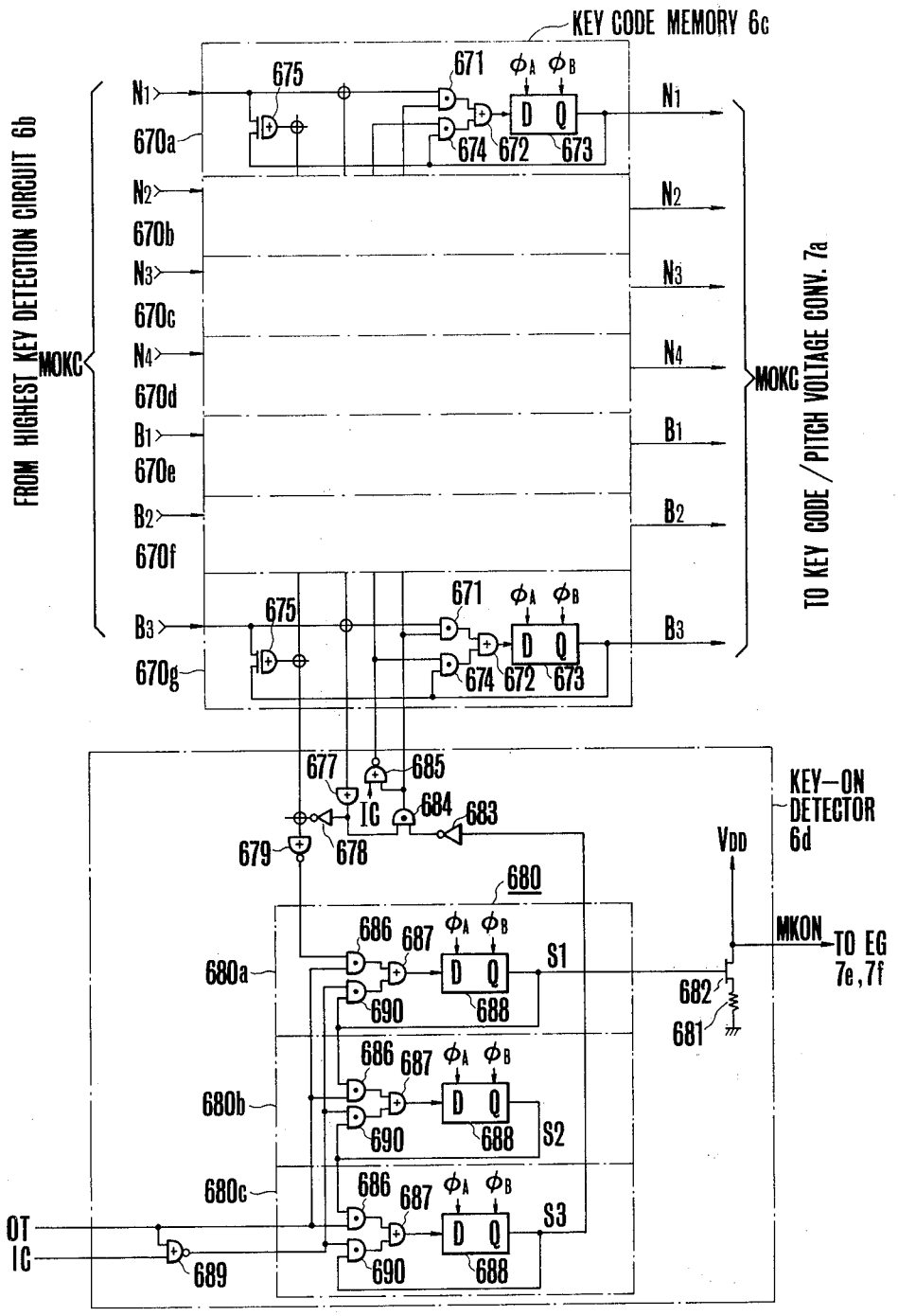
FIG. 8 is a connection diagram showing the detail of one example of the key code memory device and the key-on detector shown in FIG. 1.

FIG. 8 shows the detail of one example of the key code memory device 6c and the key-on detector 6d shown in FIG. 1. The key code memory device 6c comprises memory circuits 670a to 670g respectively supplied with and store the note code bits N1 to N4 and the block code bits B1 to B3 of the highest tone producing key code MOKC produced by the highest key detector 6b (FIG. 6). Each one of the memory circuits 670a to 670g (only the memory circuits 670a and 670 g are shown in detail) comprises an AND gate circuit 671 supplied with an input signal, a delay flip-flop circuit 673 which receives the output signal of the AND gate circuit 671 via an OR gate circuit under the control of the clock signal $\phi$A (FIG. 4) and produces the applied signal under the control of the clock signal $\phi$B (FIG. 4), and an one stage circulation type register constituted by an AND gate circuit 674 which feeds back the output of the delay flip-flop circuit 673 to the input thereof via an OR gate circuit 672. Each of the memory circuit 670a to 670g is provided with an EXCLUSIVE OR gate circuit 675 which compares the input with the output of the delay flip-flop circuit 673 for detecting the noncoincidence of the input and the output. The foregoing description concerns the construction of the key code memory device 6c.

The key-on detection circuit 6d comprises an OR gate circuit 677 connected to receive respective bits N1 to N4 and the block codes B1 to B3 of the highest tone producing key code MOKC inputted to the key code memory device 6c for producing an output signal "1" by noting the presence of a signal "1" in any one of the bits as the arrival of the key code MOKC; and NOR gate circuit 679 connected to receive the outputs of respective EXCLUSIVE OR gate circuits of the memory circuits 670a to 670g, and the output of an inverter 678 that inverts the output of the OR gate circuit 677; a 3-stage shift register 680 connected to be supplied with the output of the NOR gate circuit 679 at the time of generation of the timing signal OT for sequentially shifting the received signal at each generation of the timing signal OT; a transistor 682 connected between a source $V_{DD}$ and the ground through a resistor for producing a highest key key-on signal MKON by utilizing the first stage output of the shift register 680 as the gate input; an AND gate circuit 684 connected to be supplied with a signal obtained by inverting the output S3 of the third stage of the shift register 680 via an inverter 683 and with the output signal of the OR gate circuit 677, for supplying its output signal "1" to the AND gate circuits 671 of respective memory circuits 670a to 670g to act as the take-in strobe signals; and a NOR gate circuit 685 connected to receive the output of the AND gate circuit 684 and an initial clear signal IC for producing an output signal "1" which is used as a holding signal of the AND gate circuits 674 of respective memory circuits 670a to 670g. The shift register 680 is constituted by registers 680a to 680c which are connected in series. Each one of the registers 680a to 680c is constituted by an AND gate circuit 686 which is supplied with a signal according to the timing signal OT, a delay flip-flop circuit 688 which receives the signal produced by the AND gate circuit 686 via an OR gate circuit 687 in accordance with the clock signal $\phi$A (FIG. 4) and then produces the received signal by the timing action of the clock signal $\phi$B (FIG. 4), and an AND gate circuit enabled by the output signal "1" of the NOR gate circuit 689 inputted with the timing signal OT and the initial clear signal IC for feeding back the output signal of the delay flip-flop circuit 688 to the input thereof through an OR gate circuit 687.

In the operation of the key code memory device 6c and the key-on detector 6d described above in a case where the highest tone pitch detector 6b does not produce a highest tone producing key code MOKS, the output of the OR gate circuit 677 which detects the arrival of the key code MOKC becomes "0" with the result that the output of the inverter 678 becomes "1". Consequently, as the output of the NOR gate circuit 679 becomes "0", the shift register 679 would sequentially shift the data at each generation of the timing signal OT so that the inverter 683 which inverts the third stage output S3 of the shift register 680 would continue to produce a signal "1". Under these conditions, when the highest key detector 6b produces the highest tone producing key code MOKC at a time TA shown in FIG. 9, for example, under the control of the timing signal OT, the OR gate circuit 677 of the key-on detector 6d produces a signal "1" indicative of the arrival of the key code MOKC. The EXCLUSIVE OR gate circuit 675 of each one of the memory circuits 670a to 670g of the key code memory device 6c compares the input key code MOKC with the output signal of the delay flip-flop circuit 673 so as to detect whether the same key code MOKC is supplied continuously over a predetermined interval or not.

In this case, since the key code MOKC arrives at the first time, either one of the EXCLUSIVE OR gate circuits 675 of the memory circuits 670a to 670g produces a signal "1". As a consequence, the output of the NOR gate circuit 679 is continuously "0".

On the other hand, when the OR gate circuit 677 produces a signal "1", since the output signal of the inverter 683 is "1" as above described, the AND gate circuit 684 supplies the signal "1", as a take-in strobe signal, to the AND gate circuit 671 of each one of the memory circuits 670a to 670g of the key code memory device 6c at the same time when the output of the OR gate circuit 677 becomes "1". As the take-in signal is applied, each AND gate circuit 671 takes in respective bits N1 to N4 and blocks B1 to B3 of the highest tone producing key code MOKC produces by the highest tone detector 6b and supplies these bits and blocks to the delay flip-flop circuit 673 via the OR gate circuit 672. At this time, during an interval in which the AND gate circuit 684 is producing a take-in signal "1", the output signal of the NOR gate circuit 685 becomes "0" with the result that the AND gate circuits 674 of the respective memory circuit 670a to 670g become disabled to prevent feeding back of the output of the delay flip-flop circuits 673 to the input thereof. Accordingly, the respective bits N1 to N4 and blocks B1 to B3 of the input key MOKC are applied to the delay flip-flop circuits 673 of respective memory circuits 670a to 670g. When the highest tone producing key code MOKC which is generated only during the interval of the timing signal OT extinguishes after the termination of the timing signal OT, the output of the OR gate circuit 677 detecting the arrival of the key code MOKC becomes "0" whereby the take-in signal produced by the AND gate circuit 684 becomes "0". Then, the holding signal produced by the NOR gate circuit 685 becomes "1". As above described, when the holding signal "1" is produced by the NOR gate circuit 685, the AND gate circuit 674 of each one of the memory circuits 670a to 670g is enabled to feed back the output signal of the delay flip-flop circuit 673 to the input thereof via the OR gate circuit 672, whereby the input signal (key code MOKC) applied to the delay flip-flop circuit 673 via the AND gate circuit 671 at the time of generating the timing signal OT would be stored and held. The key code MOKC stored in respective memory circuits 670a to 670g is converted into a tone pitch voltage KV having a corresponding value by the key-code/tone-pitch-voltage converter 7a as will be described later with reference to (b) FIG. 9. At this time however, since the key-on detector 6d does not produce a key-on signal MKON, no musical tone would be produced as will be described later.

Figure 9:
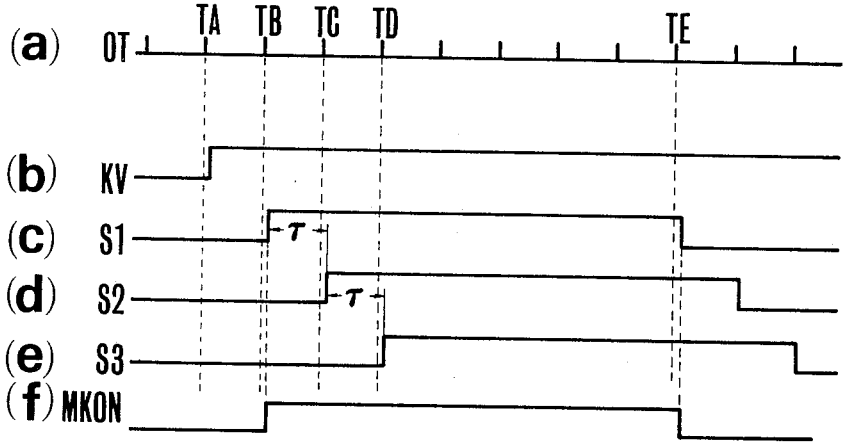
FIGS. 9 and 10 show waveforms at various portions of the key code memory device and the key-on detector shown in FIG. 8.

When a timing signal OT is generated at a time TA shown in FIG. 9, the highest tone detector 6b produces again a highest tone producing key code MOKC. Then, the OR gate circuit 677 produces a signal "1" indicative of the arrival of the key code MOKC, whereby the output signal of the inverter 678 becomes "0". The EXCLUSIVE OR gate circuit 675 of each one of the memory circuit 670a to 670g compares the newly supplied key code MOKC with the key code MOKC produced by the delay flip-flop circuit 673 at each bit so as to produce a signal "0" when they coincide with each other. Accordingly, the output signals of the EXCLUSIVE OR gate circuits 675 of respective memory circuits 670a to 670g becomes all "0" and the signal applied to the shift register 680 from the NOR gate circuit 679 becomes "1". Accordingly, this output signal "1" of the NOR gate circuit 679 shows that the highest tone producing key code MOKC supplied from the highest tone detector 6b would have the same content also in the next period (i.e. the time TB shown in FIG. 9) of the timing signal OT. Further, when the output signal of the OR gate circuit 677 becomes "1", the AND gate circuit 684 produces a take-in signal "1". Then, in the same manner as above described the AND gate circuits 671 of the respective memory circuit 670a to 670g pass the note code bits N1 to N4 and block code bits B1 to B3 of the input key code MOKC to the delay flip-flop circuit 673. Thereafter, the input key code is held by the delay flip-flop circuit 673 in the same manner as above described.

On the other hand, when the output signal of the NOR gate circuit 679 becomes "1", the AND gate circuit 686 of the register 680a comprising the first stage of the shift register 680 passes this output signal "1" to the delay flip-flop circuit 688 via the OR gate circuit 687 under the control of the timing signal OT. The delay flip-flop circuit 688 takes in the output signal of the AND gate circuit according to the timing signal $\phi$A, and sends out a signal S1 of "1" according to the timing signal $\phi$B as shown by (c) in FIG. 9. After the termination of the timing signal OT, the AND gate circuit 690 is enabled by a signal "1" produced by the NOR gate circuit 689 until the next timing signal OT is generated at a time TC shown in FIG. 9 to feed back the output signal of the delay flip-flop circuit 689 to the input thereof so that the signal "1" is held in a memorized state by being circulated through the delay flip-flop circuit 688, the AND gate circuit 690 and the OR gate circuit 687. Since the register 680b constituting the second stage of the shift register 680 takes in and holds the first stage output signal S1 of the register 680a by the timing action of the next timing signal OT (at time TC shown in FIG. 9) the output signal S2 of the shift register 680b is generated after being delayed by a time $\tau$ corresponding to one period of the signal OT from the time of producing the first stage output S1, as shown by (d) in FIG. 9. As the register 680c comprising the third stage of the shift register 680 takes in and holds the second stage output signal S2 by the timing action of the next timing signal OT (at time TD shown in FIG. 9) the output signal S3 of the register 680c is generated after being delayed by a time $\tau$ corresponding to one period of he timing signal OT from the generation of the second stage output S2, as shown by (e) in FIG. 9. The output signal S1 of the register 680a that constitutes the first stage is applied to the gate electrode of the transistor 682 thus turning on the same, with the result that the highest key key-on signal MKON becomes "1" as shown in by (f) FIG. 9. This key-on signal MKON is supplied to the EG 7e and EG 7f of the second tone production system 7 shown in FIG. 1 to initiate the generation of the control waveforms EW1 and EW2 thereby generating a musical tone signal.

The foregoing description relates to the operations of the key code memory device 6c and the key-on detector 6d when the state in which the highest tone detector 6b does not produce any highest tone producing key code MOKC is switched to a state in which a certain key code MOKC is delivered out. In this state the key-on detector 6d detects that the highest tone producing key code MOKC supplied from the highest tone detector 6b at each generation of the timing signal OT has the same content over more than one period of the timing signal OT so as to confirm that the signal imputted to the key code memory device 6c is a normal key code MOKC and is not a noise signal. This confirmation signal of the key code MOKC is outputted from the NOR gate circuit 679 as a signal "1" and the key-on detector 6d supplies this output signal of the NOR gate circuit 679 to the shift register 680 with a period of the timing signal OT, and the signal inputted into the shift register 680 is sequentially shifted, whereby a key-on signal MKON is produced corresponding to the first stage output S1 of the shift register 680.

As a consequence, the key-on detector 6d produces a highest key key-on signal MKON ("1") about one period of the timing signal OT later than the application of the highest tone producing key code MOKC from the highest tone detector 6b.

A case wherein all keys are released so that no highest tone producing key code MOKC is produced after time TE shown in FIG. 9 by the highest tone detector 6b by the timing action of the timing signal OT will now be described. At the time TE shown in FIG. 9 since the key code MOKC is not applied to the key code memory device 6c, the output of the OR gate circuit 677 is still "0" so that the output of the inverter 678 is still "1". Furthermore, the outputs of the EXCLUSIVE OR gate circuits 675 of respective memory circuits 670a to 670g are also "1". Consequently, the output of the AND gate circuit 684 is maintained at a "0" state so that the signal take-in AND gate circuits 670 of respective memory circuits 670a to 670g are not enabled. Since the outputs of the NOR gate circuits 685 are "1", the holding AND gate circuits 674 of the respective memory circuits 670a to 670g are enabled so as to feed back the output of the delay flip-flop circuit 673 to the input thereof thereby holding its memory. Consequently, the memorized key code MOKC outputted from the key code memory device 6c remains unchanged regardless of the fact that all keys have been released with the result that the tone pitch voltage KV produced by the key-code/tone-pitch-voltage converter 7a is maintained unchanged.

As above described, since the outputs of the inverter 678 and the EXCLUSIVE OR gate circuit 675 are both "1", the output of the NOR gate circuit 679 is "0". For this reason, regardless of the generation of the timing signal OT, a signal "1" is not supplied to the first stage register 680a of the shift register 680. Further, the memory of the register 680a is cleared at the time of generation of the timing signal OT (i.e. the holding AND gate circuit 690 is disabled) so that the output S1 of the register 680a becomes "0" immediately after the time TE as shown by (c) in FIG. 9. Consequently, the transistor 682 is turned off to render the highest key key-on signal MKON to become "0" whereby the generation of the musical tone signal by the second tone production system 7 is transferred to the decay operation.

At this time, since the key code memory device 6c continues to store the key code MOKC even after the key release, the tone pitch does not change at the decay portion of the produced musical tone.

Figure 10:
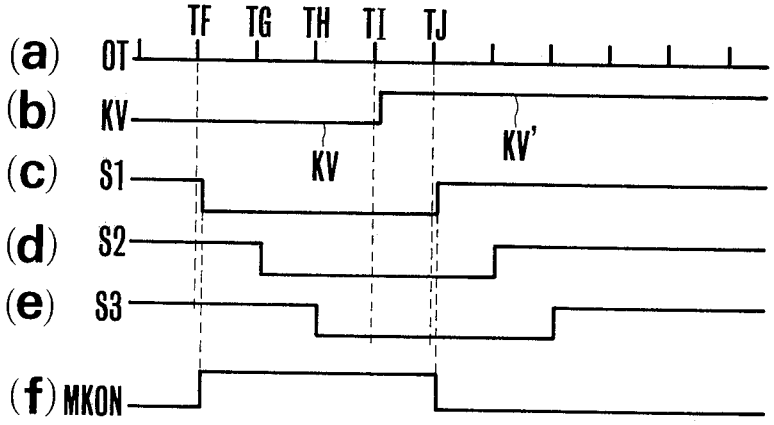

Then, as shown in FIG. 10, when the highest tone producing key code MOKC produced at time TF by the highest tone detector 6b by the timing action of the timing signal OT changes to another key code MOKC representing another tone pitch, in other words as the key code having a still higher tone pitch is produced, the key code MOKC held in the key code memory device 6c is compared with a new key code MOKC. At this time, since both key codes do not coincide with each other, the NOR gate circuit 679 produces a signal "0" which is applied to the shift register 680 so that the signal applied to the shift register 680 and produced from the first stage thereof as the output signal S1 becomes "0" immediately after the time TF as shown by (c) in FIG. 10. As a consequence, the key-on signal MKON produced by the transistor 682 supplied with the first stage output S1 of the shift register 680 as a gate input becomes "0" with the result that the EG 7e and EG 7f of the second tone production system 7 produce control waveforms EW1 and EW2 for imparting a decay thereby gradually decreasing the amplitude of the produced musical tone signal. Since the third stage output S3 of the shift register 680 is "1" as shown by (e) in FIG. 10 at the time of arrival of the new key code MOKC the output of the inverter 683 becomes "0" thus preventing the AND gate circuit 684 from producing a take-in signal. Accordingly, the key code memory device 6c continues to hold the previous key code MOKC.

The first stage output signal S1 ("0" as shown in FIG. 10) of the shift register 680 is shifted to the register 680b of the second stage at a time TG of generating the second timing signal OT and the output signal S2 of the second stage register 680b becomes "0" immediately after the time TG (as shown in FIG. 10). This output signal S2 is shifted to the third stage register 680c at a time TH of generating the next timing signal OT, and the output of the third stage register 680c becomes "0" immediately after the time TH. As above described, when the highest tone producing key code MOKC outputted from the highest tone detector 6b changes, at the third period of the timing signal OT, the output signal S3 of the shift register 680 becomes "0" as shown in FIG. 10. As a consequence, the output of the inverter 683 becomes "1" to cause the AND gate circuit 684 to send a take in signal to the key code memory device 6c. Consequently, in the key code memory device 6c is stored a new highest tone producing key code MOKC which has been changed at the fourth period (time TI) of the timing signal OT after it had been changed at the first time, and a tone pitch voltage KV' is produced at time TI as shown in FIG. 10b by the key code-tone pitch voltage converter 7a which converts the stored highest tone producing key code MOKC into a corresponding tone pitch voltage. When the new key code MOKC is stored and held by the key code memory device 6c the output of the NOR gate circuit 679 becomes "1" at the time TJ of generating the next timing signal. This output signal "1" applied to the shift register 680 in synchronism with the generation of the timing signal OT at the time TJ so that the first stage output S1 of the shift register 680 becomes "1" immediately after the time TJ as shown by (c) in FIG. 10. Then, the transistor 682 produces a key-on signal MKON ("1" ) to cause the second tone producing system 7 to produce musical tone signal having a tone pitch corresponding to the key code MOKC outputted from the key code memory device 6c. As a consequence, when the highest tone producing key code MOKC produced by the highest tone detector 6b is changed, the key-on signal MKON instantly becomes "0" so that the key-on signal MKON becomes again to "1" at and after the fifth period of the timing signal OT to produce a musical tone signal having a tone pitch corresponding to the modified key code MOKC. In this manner, when the highest tone producing key code MOKC produced by the highest tone detector 6b is changed, the generation of the key-on signal MKON ("1") is inhibited for four periods (from time TF to time TJ) of the timing signal OT for the reason that, when producing a musical tone signal corresponding to the modified key code MOKC by the second tone producing system 7, it is necessary to reset the EG 7e and EG 7f for the purpose of imparting the envelope beginning with the first portion (attack portion). For resetting the EG 7e and EG 7f a time length of four periods of the timing signal OT are necessary.

F Another Embodiment of the Highest Tone Detector 6b

Figure 11:
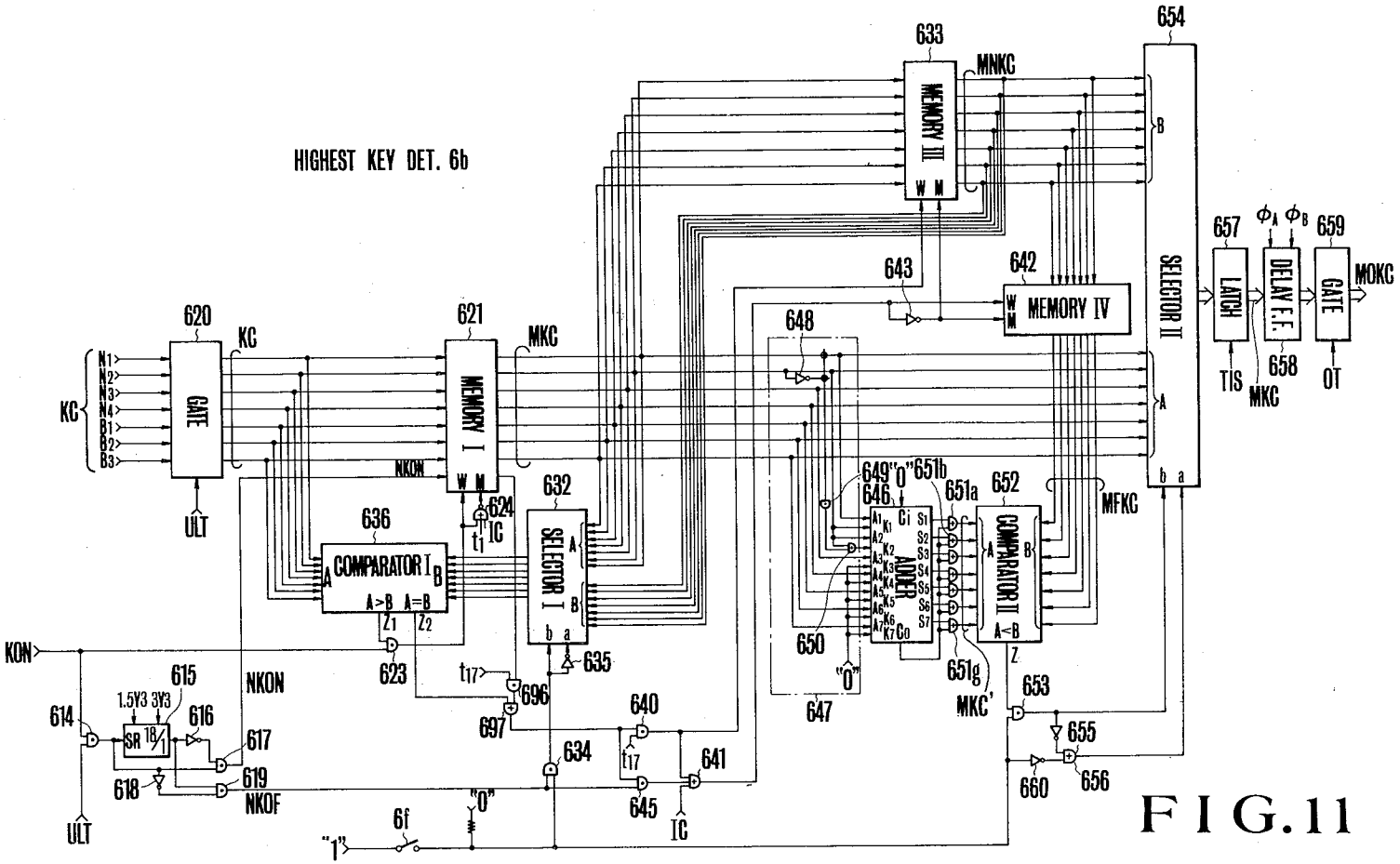
FIGS. 11 through 14 are connection diagrams showing the other modifications of the highest key detector shown in FIG. 1.

FIG. 11 shows the detail of another embodiment of the highest tone detector 6b in which elements identical to those shown in FIG. 6 are designated by the same reference charactors for the purpose of avoiding repeated description thereof. The modification shown in FIG. 11 is different from the embodiment shown in FIG. 6 in that the second memory device 622 is omitted for the purpose of supplying the highest tone key code MKC produced by the first memory device 621 directly to the third memory device 633, that the first memory device 621 is provided with an additional bit for storing the key-on signal KON newly outputted from the AND gate circuit 617 so as to deliver a new-key-on signal NKON produced by the first memory device 621 from the AND gate circuit 696 at the time of generating the timing signal t17, and that the output of the AND gate circuit 696 and a signal outputted from the output terminal Z2 of the comparator 636 are applied to an AND gate circuit 640 via an OR gate circuit 697.

In the modification shown in FIG. 11, a special memory device which judges that whether the highest tone key code MOKC stored in the first memory device 621 is a new key code NKC or not is not provided, but instead a bit is added to the first memory device 621 for simultaneously storing the new key-on signal and the key code KC in the first memory device 621 so as to judge that whether the key code KC is a new key code or not according to the content ("1" or "0") of the new-key-on signal NKON stored in the first memory device 21. More particularly the content of the first memory device 621 is rewritten whenever a large valued key code KC is supplied so that at the end of the 15th production channel time, the maximum value of the key code KC inputted during the second to the 15th production channel times is left. However, when a new-key-on signal NKON is inputted to the first memory device corresponding to the key code KC, the new-key-on signal NKON ("1") would be produced simultaneously from the first memory device 621 where the highest key key-code MKC finally remaining in the first memory device 621 is the new-key-code NKC. Accordingly, by discriminating the output of the bit added to the first memory device 621 it is possible to judge whether the highest key key-code MKC is the new-key-code NKC or not. To this end, the new-key-on signal NKON produced by the first memory device 621 is derived out through the AND gate circuit 696 in synchronism with the timing signal t17, and the output signal "1" of this AND gate circuit 696 is supplied to the AND gate circuit 640 via the OR gate circuit 697 thus storing in the third memory device 633 the new-key-code NKC as the highest key new-key-code MNKC by the timing action of the timing signal t17. In this case, the second memory device 622 becomes unnecessary thereby greatly simplifying the construction.

Figure 12:
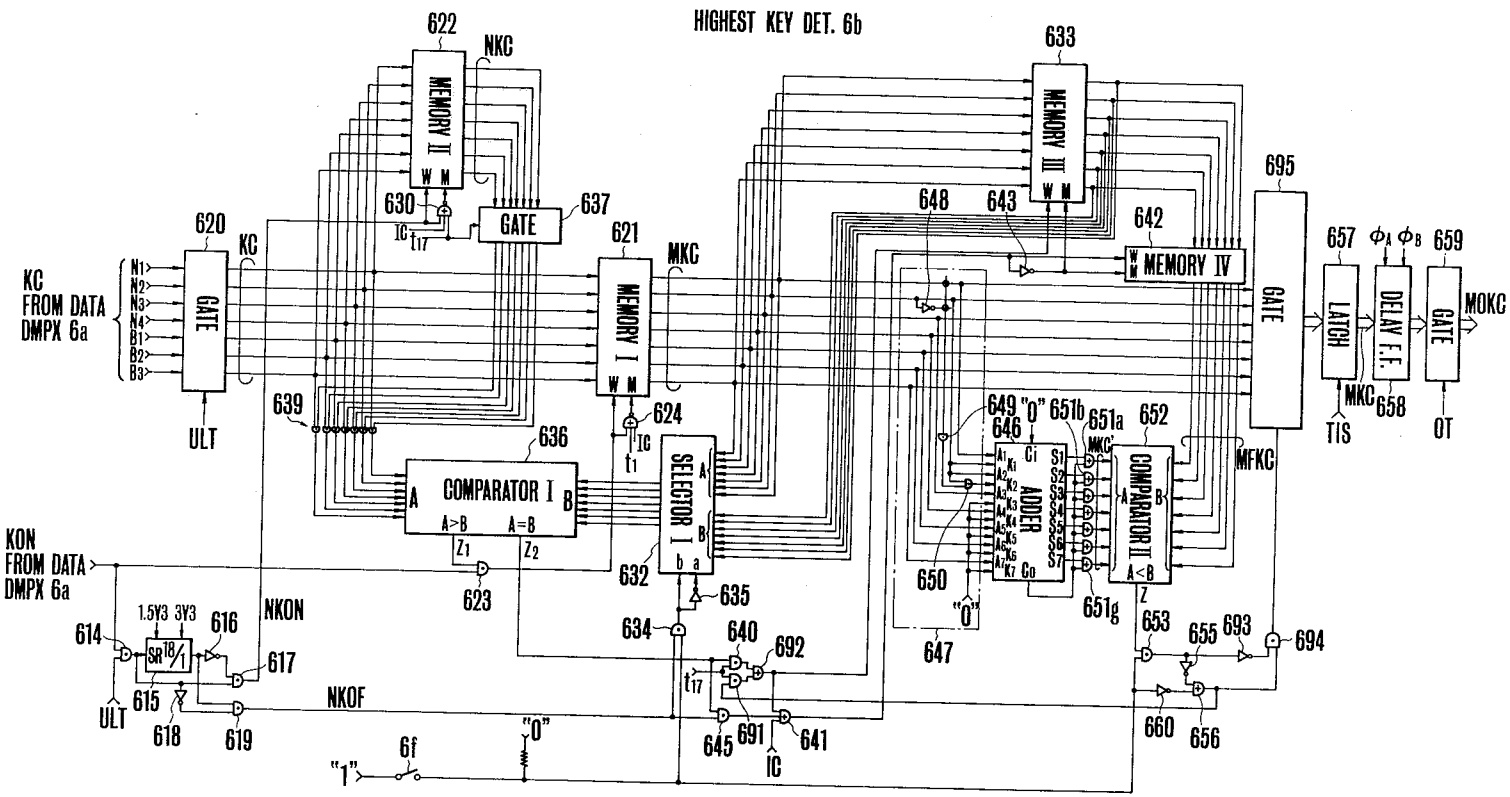

FIG. 12 is a connection diagram showing a modification of the highest tone detector 6b shown in FIG. 6, in which elements 6b corresponding to those shown in FIG. 6 are designated by the same reference characters.

The circuit shown in FIG. 12 is different from that shown in FIG. 6 in that the output signal of an AND gate circuit 691 inputted with the timing signal t17 and the output of the OR gate circuit 656 is applied to the third memory device 633 via an OR gate circuit 692 to act as a write signal W and also to the OR gate circuit 641 that an AND gate circuit 694 is provided which is inputted with a signal produced by inverting the output of the AND gate circuit 653, and the output signal of the OR gate circuit 656, that a gate circuit 695 enabled by the output signal ("1") of the AND gate circuit 694 is provided between the first memory device 621 and the latch circuit 557, and that the highest key key-code MKC produced by the first memory device 621 is applied to the third memory device 633.

The modified highest tone detector 6b operates as follows. More particularly, while the tone production control switch 6f is being closed to establish the "tone production control mode", when the signal outputted from the output terminal of the comparator 652 becomes "0", the output signal of the AND gate circuit 694 becomes "0" to turn ON the gate circuit 695 thus producing the highest key key-code MKC outputted from the first memory device 621 as the highest tone producing key code MOKC. Under these conditions, the output signal "1" of the OR gate circuit 656 is applied to the AND gate circuit 691 by the timing action of the timing signal t17 to supply the output signal "1" to the OR gate circuits 692 and 641. Accordingly, the newly detected highest key key-code MKC that has been stored in the first memory device 621 is transferred to the third memory device and the previously detected highest key key-code MKC that has been stored in the third memory device 633 is stored in the fourth memory device 642 as the highest key off-key code MFKC.

When the output signal of the output terminal Z of the comparator 652 becomes "1" the output signal of the AND gate circuit 653 also becomes "1". As a consequence, the output signal of the AND gate circuit 694 becomes "0" to turn off the gate circuit 695 thereby inhibiting the highest key key-code MKC from being outputted. At this stage, since the output signal of the OR gate circuit 656 is "0", the AND gate circuit 691 does not produce signal "1" by the timing action of the timing signal t17 with the result that the contents of the third and fourth memory devices 633 and 642 are not changed.

As a consequence in this modification, in the third memory device 633 is stored the highest key key-code MKC of the first memory device which is now being outputted as the highest tone producing key code MOKC together with the highest key new-key-code MNKC, whereas in the fourth memory device 642 is stored the previous highest key key-code MKC which has been outputted as the highest tone producing key code MOKC.

As a consequence in the modification shown in FIG. 12, in addition to the above described processes (1) and (2) executed in the embodiment shown in FIG. 6, where the keys corresponding the highest tone key code MKC are sequentially released, a judgment is made as to whether the next new highest key key-code MKC is lower by more than 200 cents or not than the previous highest key key-code MKC (the highest tone previously produced) that has been outputted as the highest tone producing key code MOKC. If the difference were equal to or less than 200 cents, the new highest key key-code MKC would be produced as the highest tone producing key code MOKC, whereas where the difference is greater than 200 cents the new highest key key-code MKC would not be produced. The contents of the first to fourth memory devices and the content of the highest tone producing key code MOKC when the highest tone detector **6*b* shown in FIG. 12 operated in the "tone production control mode" are shown in the following Table VIII which shows the data at the time of generating the timing signal t17**.

TABLE VIII

| se-quence | note name of depressed key | newly depressed key (NKON) | newly released key (NKOF) | first memory (621) | second memory (622) | third memory (633) | fourth memory (642) | highest tone producing ley code (MOKC) |
|---|---|---|---|---|---|---|---|---|
| T0 | — | | | — | — | — | — | — |
| T1 | D4 | D4 | | D4 | D4 | D4 | — | D4 |
| T2 | D4, F4 | F4 | | F4 | F4 | F4 | D4 | F4 |
| T3 | D4, F4, G4 | G4 | | G4 | G4 | G4 | F4 | G4 |
| T4 | D4, F4, G4, A4 | A4 | | A4 | A4 | A4 | G4 | A4 |
| T5 | D4, F4, G4 | | A4 | G4 | — | G4 | — | G4 |
| T6 | D4, F4 | | G4 | F4 | — | F4 | — | F4 |
| T7 | D4 | | F4 | D4 | — | — | F4 | — |
| T8 | D4, F4 | F4 | | F4 | F4 | F4 | — | F4 |
| T9 | F4 | | D4 | F4 | — | F4 | F4 | F4 |
| T10 | C#4, F4 | C#4 | | F4 | C#4 | F4 | F4 | F4 |
| T11 | C#4 | | F4 | C#4 | — | — | F4 | — |
| T12 | | | C#4 | — | — | — | F4 | — |

Figure 13:
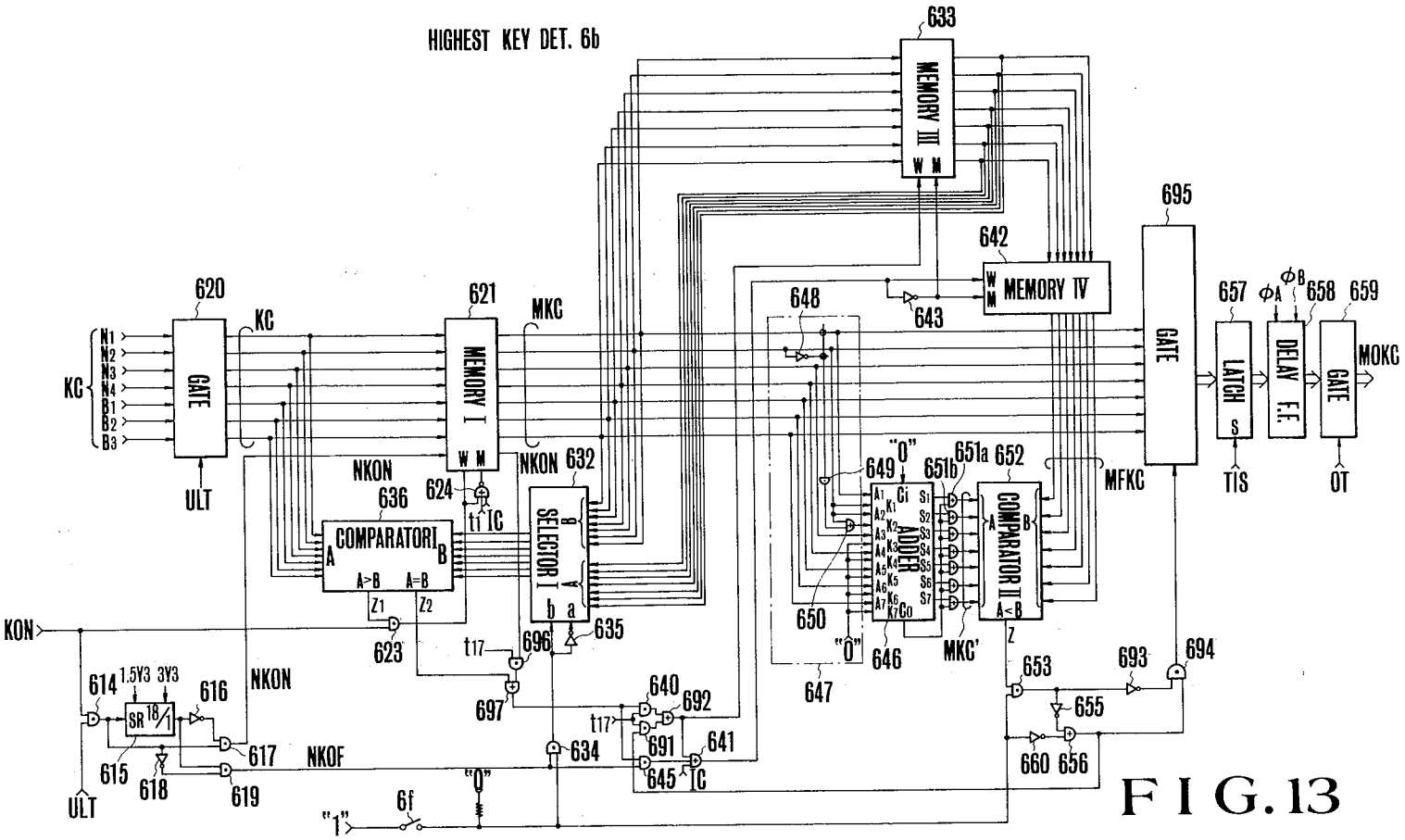

FIG. 13 shows the detail of a modification of the highest tone detector **6*b* in which circuit elements corresponding to those shown in FIG. 12 are designated by the same reference characters. This modification is different from the circuit shown in FIG. 12 in that the second memory device 622 is omitted and that a bit for the new-key-on signal NKON is added to the first memory device. As has been described in connection with FIG. 11, where the first memory device 621 produces a new-key-on signal NKON, the highest key key-code MKC produced by the first memory device 621** is stored in the third memory device as the highest key new-key-code MNKC.

Still Another Modification of the Highest Tone Detector 6*b*

Figure 14:
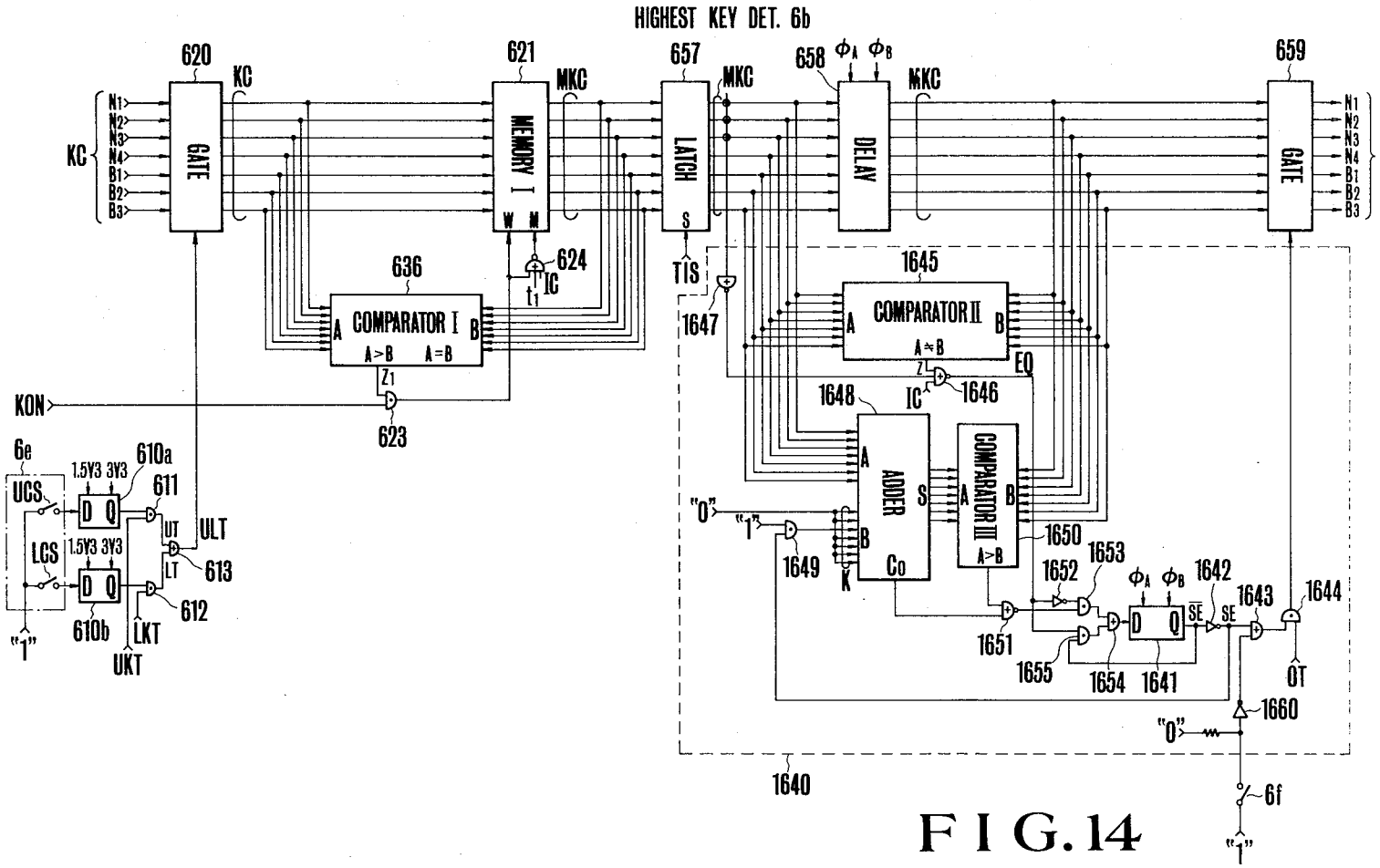

FIG. 14 shows still another modification of the highest tone detector **6*b* shown in FIG. 6 which circuit elements corresponding those shown in FIG. 6 are designated by the same reference characters. The output signals produced by the UK selection switch UCS and the LK selection switch LCS of the selection switch group 6*e* are applied to the inputs of AND gate circuits 611 and 612 respectively via delay flip-flop circuits 610*a* and 610*b* together with the timing signal UKT (FIG. 4) produced by the timing signal generator 9 shown in FIG. 2. When the UK selection switch UCS is closed, the AND gate circuit 611 produces UK selection signal UT which becomes "1" only for an interval in which a timing signal UKT is generated which represents an interval (the second to the 8th channel times shown in Table VI) in which data (key code UKC and key-on signal KON) regarding the tone production channels for the upper keyboard are produced by the latch circuit 603 (FIG. 5) when the UK selection switch UCS is closed. The output signal of the delay flip-flop circuit 610*b* is applied to the AND gate circuit 612 together with the timing signal LKT (FIG. 4). On the other hand, the AND gate circuit 612 produces a LK selection signal LT which becomes "1" only during an interval in which a timing signal LKT is generated which represents an interval (the 9th to the 15th channel times) in which data (key code LKC and key-on signal KON) regarding the tone production channels for the lower keyboard are produce by the latch circuit 603 when the LK selection switch LCS is closed. In the same manner, as in FIG. 6, the outputs of the AND gate circuits 611 and 612 are derived out as the UK selection signal and the LK selection signal LT, and these signals are outputted through an OR gate circuit 613** as a ULK selection signal ULT.

In the same manner as in FIG. 6, the key code KC (block code bits B3 to B1 and note code bits N4 to N1) outputted from the data demultiplexer **6*a* (FIG. 5) are also sent to the gate circuit 620 which is enabled by the ULK selection signal ULT produced by the OR gate circuit 613 for supplying a key code KC to the first memory device 621 and to the input A of the first comparator 636**.

As a consequence, the gate circuit 620 takes out only the key codes of a keyboard selected by the UK and LK selection switches among the key codes of respective tone production channels, which are sent on the time division basis, as shown in Table VI, and then applies the taken out key codes to the first memory device 621 and the first comparator 636. The first memory device 621 is written in with the input key code KC by using the signal "1" outputted from the AND gate circuit 623 as a write signal W and utilizes as a holding signal M a signal "1" produced by a NOR gate circuit 624 inputted with the output signal of the AND gate circuit 623, the timing signal t2 (FIG. 4) and the initial clear signal IC.

The first comparator 636 is connected to receive at its input A the output (key code KC) of the gate circuit 620 and at its input B the output of the first memory device 621 and supplies a signal "1" to the AND gate circuit 623 from its output terminal Z1 only when A>B. As a consequence, the first comparator 636 compares the output key code KC from the gate circuit 620 and the output key code from KC the memory device 621 during an interval (the second to the 15th production channel times) of generating the ULK selection signal ULT.

For the purpose of description, in the following description, it is assumed that both UK selection switch UCS and the LK selection switch LCS are closed so that the ULK selection signal ULT becomes "1" during the second to the 15th production channel times. In this case, the first memory device 621 is reset by the initial clear signal and furthermore periodically reset by the timing signal t1 in the first production channel time so that when the gate circuit 620 produces a first key code KC in the second channel time, the condition A>B is satisfied and then a signal "1" is sent from the output terminal Z1 of the first comparator 636 to the AND gate circuit 623. This AND gate circuit is enabled by the signal "1" sent from the first comparator 636 and the key-on signal KON, and when a key regarding the key code KC of the second channel time is in a depressed state, the AND gate circuit 623 supplies its output signal "1" to the memory device 621 to act as the write signal W. When the write signal W becomes "1", the first memory device 621, is written with and stores the key code KC produced by the gate circuit 620. In the next third channel time, the memory device 621 produces the key code KC which was written in the second channel time and the read out key code KC is applied to the input B of the key code KC outputted from the gate circuit 620 at this time with the key code KC outputted from the memory device 621, and when the condition A>B is satisfied a write signal W is generated in the same manner as above described to write the output key code KC of the gate circuit 620 into the memory device 621. Where the condition A>B does not hold, the output key code KC (the key code during the second channel time) of the first memory device 621 is continuously stored without any change. This operation is executed in respective channel times of the second to the 15th channel times. As a consequence, upon completion of the 15th channel time the first memory device 621 is holding the key code of the highest tone pitch (maximum value) among the key code KC corresponding to the depressed keys of a keyboard designated by the keyboard selection switch group 6e. This key code regarding the highest tone pitch is held until a timing signal t1 (FIG. 4d) is generated in synchronism with the next first channel time and the key code thus held is cleared when the timing signal t1 is generated.

The key code KC regarding the highest key and produced by the first memory device 621 is latched by the latch circuit 657 as the highest key key-code MKC according to the timing signal TIS generated in synchronism with the building up of the first channel time and the latched highest key key-code MKC is periodically rewritten each time the timing signal TIS is generated. The highest key key-code MKC outputted from the latch circuit 657 is applied to the delay circuit 658 driven by the clock pulses $\phi$A and $\phi$B shown in FIG. 4b after being delayed by a cycle (one period) of the first to the 18th channel times and then applied to the key code memory device 6c through a gate circuit 659 controlled by the tone production control circuit 1640 to be described later.

The tone production control circuit 1640 controls the production or nonproduction of a musical tone corresponding to the highest key key-code MKC outputted from the latch circuit 657 (that is whether the gate circuit 659 should be enabled or not) and such control is performed by a tone production control signal $\overline{SE}$ produced by a delay flip-flop circuit 1641 contained in the tone production control circuit 1640. The tone production control signal $\overline{SE}$ is inverted into SE by an inverter 1642 and then applied to an AND gate circuit 1640 through an OR gate circuit 1643. The AND gate circuit 1644 is inputted with the timing signal OT to be enabled thereby. As a consequence, where the tone production control signal $\overline{SE}$ is "0", a signal "1" is inputted to the AND gate circuit 1644 so that it produces a signal "1" each time the timing signal OT is generated, the signal "1" being applied to the gate circuit 659 thus enabling the same.

Consequently, the highest key key-code MKC is applied to the key code memory device 6c (FIG. 1) through the delay circuit 658 and the gate circuit 659 as the highest tone producing key code MOKC, whereby a musical tone signal corresponding to the highest tone producing key code MOKC would be produced by the second tone production system 7 in a manner as will be described later. When the tone production control signal $\overline{SE}$ is "1", as the signal "0 " is applied to the AND gate circuit 1644 thus disabling the same with the result that the gate circuit 659 would not be enabled (OFF). Thus, at this timing the highest tone producing key code MOKC is not supplied to the key code memory device 6c so that a musical tone signal corresponding thereto would not be produced, that is the tone production would be inhibited. At this time, the output signal of the tone production control switch 6f is applied to the OR gate circuit 1643 via an inverter 1660 so that when this switch is off (normal mode) the OR gate circuit 1643 normally produces a signal "1" which is straight forwardly applied to key code memory device 6c as the highest tone producing key code MOKC. Thus, at this time a musical tone signal corresponding to the highest key key-code KC is constantly generated. Where the tone production control switch 6f is closed (tone producing control mode) its output signal becomes "0". In this case the tone production is controlled by the tone production control signal $\overline{SE}$ as above described. This tone production control signal $\overline{SE}$ is formed as follows:

The input A of a second comparator 1645 of the tone production control circuit 1640 is supplied with the highest key key-code MKC released by the latch circuit 657, while the input B is supplied with the highest key key-code MKC delayed by the delay circuit 658. Thus, the second comparator 1645 compares both inputs with each other and produces a signal "1" from its output Z when both inputs do not coincide with each other (A≠B). In other words, the comparator 1645 produces a signal "0" and A=B. The output of the second comparator 1645 is applied to a NOR gate circuit 1646 which is also supplied with the output signal of a NOR gate circuit 1647 connected to receive the bit signals N3 to N1 of the highest key key-code MKC produced by the latch circuit 657, and the initial clear signal IC. As a consequence, the NOR gate circuit 1646 produces a coincidence signal EQ of "1" only when the highest key key-code MKC released from the latch circuit 657 is identical to that produced in one cycle before, that is only when the highest key key-code MKC latched by the latch circuit 657 remains unchanged. The reason that the output signal of the NOR gate circuit 1647 is also applied to the NOR gate circuit 1646 is to produce the coincidence signal EQ only when the latch circuit 657 produces a certain highest key key-code MOKC thereby inhibiting the coincidence signal from being generated when both latch circuit 657 and the delay circuit 658 do not produce a signal.

An adder 1648 is provided with its input terminal A connected to receive the highest key key-code MKC released by the latch circuit 657 and its input terminal B connected to receive a predetermined data K to be added thereby producing the sum (MKC+K) from its output terminal S. The added value data K is set to either one of "0000000" and "0000100" according to the output of an AND gate circuit 1649 controlled by the aforementioned tone production control signal produced by the inverter 1642.

More particularly, when the tone production control signal SE is "1", the added value data K is set to "0000100" (decimal "4") whereas when the tone production control signal SE is "0" the signal SE is set to "0000000" (decimal "0"). As a consequence, when the tone production control signal SE is "1" (that is when the tone production of the highest key key-code MKC of one cycle before is permitted), the adder 1648 adds the highest key key-code MKC released by the latch circuit 657 to a decimal "4", whereas when the tone production control signal SE is "0", that is when the tone production of the highest key key-code MKC one cycle before is inhibited, no addition operation is performed. The highest key key-code MKC is added to the added value data K of "0000100" for the purpose of forming a key code which is 300 cents higher than the highest key key-code MKC. More particularly, as can be clearly noted from Tables II and III, a key code KC produced by adding together the key code KC and "0000100" (decimal "4") always represents a key higher than the original key code KC by three key codes that is a key having 300 cents higher tone. In this manner, by adding together the highest key key-code MKC and decimal "4" a key code is formed having a tone pitch higher than the highest key key-code MKC by 300 cents (three keys). This process is performed for the purpose of detecting whether a new highest key key-code MKC is within a predetermined interval range (in this embodiment, equal to or less than 200 cents) with respect to the previous highest key key-code MKC one cycle before. In this regard, the respective keys (respective tone pitches) are separated by 100 cents. The sum output of the adder 1648 is supplied to the input A of a third comparator 1650 with its input B applied with the previous highest key key-code MKC one cycle before whereby a signal "1" is produced from its output terminal Z only when a condition A>B is satisfied as a result of comparison of both inputs. For the purpose of description, the following description is made on the assumption that the tone production control signal SE is "1" and that the added value K is "0000100".

Accordingly, the condition under which the third comparator 1650 produces a signal "1" is that under which the new highest key key-code MKC produced from the latch circuit 657 is not apart from the previous highest key key-code MKC one cycle before produced by the delay circuit 658 by not more than 300 cents to the lower tone side, that is equal to or less than 200 cents (also includes a case in which both highest key key-codes are identical). The output of the third comparator 1650 is applied to the NOR gate circuit 1651. As a consequence, the NOR gate circuit 1651 produces a signal "1" when the new highest key key-code MKC is apart from the previous highest key key-code MKC one cycle before by 300 cents or more on the lower tone side, but produces a signal "0" when the difference is not more than 300 cents (that is equal to or less than 200 cents). When the sum of the highest tone key code and the addend data K ("0000100") overflows, the comparator 1650 can not perform a correct comparison so that a carry signal produced by a carry output terminal C0 of the adder 1648 is applied to the NOR gate circuit 1651 so as to make "0" the output of the NOR gate circuit 1651 where the sum of the adder 1648 overflows to produce the carry signal.

The output signal of the NOR gate circuit 1651 is supplied to an AND gate circuit 163 which is also applied with the coincidence signal EQ produced by the NOR gate circuit 1646 via an inverter 1652. The AND gate circuit 1653 is enabled when the new highest key key-code MKC released from the latch circuit 630 varies (the coincidence signal EQ becomes "0") and when this varied new highest key key-code MKC is apart from the previous highest key key-code MKC one cycle before by 300 cents or more to the lower tone side, i.e. when the output signal of the NOR gate circuit 1651 is "1", for applying via an OR gate circuit 1654 a signal "1" to a delay flip-flop circuit 1641 driven by the clock signals $\phi$A and $\phi$B shown in FIG. 4. As the coincidence signal EQ becomes "0", and AND gate circuit 1655 is disabled so that the tone production control signal $\overline{SE}$ produced thereby is not applied to the delay flip-flop circuit 1641 but only the output signal of the AND gate circuit is applied to the delay flip-flop circuit 1641. Accordingly, into the delay flip-flop circuit 1641 is written a signal "1" when the new highest key key-code MKC produced by the latch circuit 657 is separated from the previous highest key key-code MKC by 300 cents or more on the lower tone side, whereas a signal "0" when the difference is equal to or less than 200 cents. Like the delay circuit 658 the signal written into the delay flip-flop circuit 1641 is delayed by one cycle time in which the first to the 18th channel times circulate once, and this delayed signal is outputtted as the tone production control signal $\overline{SE}$ for the new highest key key-code MOKC released from the latch circuit 657. The tone producing control signal $\overline{SE}$ thus formed is fed back to the delay flip-flop circuit 1641 via an AND gate circuit 1655 supplied with the coincidence signal EQ produced by the NOR gate circuit 1646, and held in the delay flip-flop circuit 1641. The signal held therein is cleared when the coincidence signal EQ becomes "0", that is the new highest key key-code MKC produced by the latch circuit 657 varies again, or the latch circuit 657 produces no more highest key key-code MKC, that is when all depressed keys in the keyboard selected by the keyboard selection switch group **6*e*** have been released.

As a consequence, a highest key key-code MKC would be latched by the latch circuit when the tone production control signal $\overline{SE}$ for the previous highest key key-code MKC outputted one cycle before from the delay flip-flop circuit 1641 is "0" so that the highest key key-code MKC is supplied to the key code memory device **6*c* (that is while a musical tone corresponding to the highest tone producing key code MOKC is being produced). Then, when the new highest key key-code MKC is identical to the previous highest key key-code MKC (i.e., when the coincidence signal EQ is "1") the tone production control signal is maintained in the present state, whereas when the highest key key-code MKC varies, i.e., when the coincidence signal EQ becomes "0" a tone production control signal SE for such varied new highest key key-code MKC is formed. If the new highest key key-code MKC is not separated from the previous highest key key-code by 300 cents or more (that is equal to or less than 200 cents), the output signal of the NOR gate circuit 1651 becomes "0". Accordingly, the tone production control signal $\overline{SE}$ also becomes "0" to turn on the gate circuit 659 so that the new highest tone producing key code MOKC is supplied to the key code memory device 6c thus making it possible to produce a musical tone. On the other hand, if the new highest key key-code MKC is separated from the previous highest key key-code MKC by 300 cents or more to the lower tone side, the output signal of the NOR gate circuit would becomes "1" so that the tone production control signal $\overline{SE}$ also becomes "1" thus turning off the gate circuit 654. Thus, the new highest tone producing key code MOKC is not supplied to the key code memory circuit 6c**, thereby inhibiting tone production.

A case in which the new highest key key-code MKC is latched again by the latch circuit 657 while the tone producing control signal $\overline{SE}$ is "1" to inhibit the tone production will now be described. When the tone production control signal $\overline{SE}$ becomes "1" the AND gate circuit 1649 is disabled as above described so that the added values "0000000" (decimal "0") whereby the adder 1648 continues to output the new highest key key-code MKC produced by the latch circuit 659. Consequently, in this case, the third comparator 1650 produces a signal "1" only when the new highest key key-code MKC released by the latch circuit 657 has a tone pitch higher than that of the previous highest key key-code MKC (tone production thereof is inhibited) produced one cycle before by the delay circuit 658. As a consequence, the tone production control signal $\overline{SE}$ becomes "0" when the new highest key key-code MKC has a tone pitch higher than that of the previous highest key key-code MKC, whereas when the new highest key key-code MKC is identical to the previous highest key key-code MKC, or has a tone pitch lower than the later, the tone production control signal SE becomes "1". In this manner, the new highest tone producing key code MOKC is supplied to the key code memory device 6c only when its tone pitch is higher than that of the previous highest tone producing key code MOKC. In this manner, where the tone production for the previous highest key key-code MKC is inhibited, it is possible to prevent undue production of the highest tone having a tone pitch much lower than that of the highest tone which is prevented from being produced because of low tone pitch, by judging whether the new highest key key-code has a tone pitch higher than the previous highest key key-code MKC or not instead of determining whether the new highest key key-code MKC is apart from the previous highest key key-code MKC by 300 cents or more or not.

While the foregoing description relates to the construction and operation of the highest tone detector 6b, the relationship between the contents of the signals at various portions of this circuit and the state of key operation is shown in the following Table IX in which the name of the keyboard (the upper keyboard UK or the lower keyboard LK) to which the depressed keys belong is omitted for the purpose of simplifying the description. In Table IX symbols T1', T2', T3', T4', T5', T6', T7' and T8' represent the times which is later than the times T1, T2, T3, T4, T5, T6, T7 and T8 respectively which are later by period than the clock signals $\phi A$ and $\phi B$.

Since the highest tone detector 6b shown in FIG. 14 is constructed such that the delay circuit 658 produces a previous highest key key-code MKC one cycle before the highest key key-code MKC produced by the latch circuit 657 the delay circuit can be considered as a temporary circuit. For this reason the delay circuit 658 may be substituted by a temporary memory of different construction. Furthermore, while in this embodiment, the gate circuit 659 is supplied with the delayed highest key key-code MKC produced by the delay circuit 658, it is also possible to directly apply the highest key key-code MKC delivered by the latch circuit 657.

TABLE IX

| sequence | note name of depressed key | output of latch circuit 657 (MKC) | output of delay circuit 658 (MKC) | output of NOR gate circuit 1646 (EQ) | output of NOR gate circuit 1651 | output of OR gate circuit 1654 | output of delay flip-flop 1641 ($\overline{SE}$) | output of inverter 1642 (SE) | output of gate circuit 659 (MOKC) |
|---|---|---|---|---|---|---|---|---|---|
| T0 | — | — | — | "0" | "1" or "0" | "1" or "0" | "1" or "0" | "0" or "1" | — |
| T1 | D4 | D4 | — | "0" | "0" | "0" | "1" or "0" | "0" or "1" | — |
| T1' | D4 | D4 | D4 | "1" | "0" | "0" | "0" | "1" | D4 |
| T2 | D4, E4 | E4 | D4 | "0" | "0" | "0" | "0" | "1" | D4 |
| T2' | D4, E4 | E4 | E4 | "1" | "0" | "0" | "0" | "1" | E4 |
| T3 | D4, E4, A4 | A4 | E4 | "0" | "0" | "0" | "0" | "1" | E4 |
| T3' | D4, E4, A4 | A4 | A4 | "1" | "0" | "0" | "0" | "1" | A4 |
| T4 | D4, E4 | E4 | A4 | "0" | "1" | "0" | "0" | "1" | A4 |
| T4' | D4, E4 | E4 | E4 | "1" | "1" | "1" | "1" | "0" | — |
| T5 | D4 | D4 | E4 | "0" | "1" | "1" | "1" | "0" | — |
| T5' | D4 | D4 | D4 | "1" | "1" | "1" | "1" | "0" | — |
| T6 | D4, D#4 | D#4 | D4 | "0" | "0" | "1" | "1" | "0" | — |
| T6' | D4, D#4 | D#4 | D#4 | "1" | "0" | "0" | "0" | "1" | D#4 |
| T7 | D4 | D4 | D#4 | "0" | "0" | "0" | "0" | "1" | D#4 |
| T7' | D4 | D4 | D4 | "1" | "0" | "0" | "0" | "1" | D4 |
| T8 | — | — | D4 | "0" | "1" | "0" | "0" | "1" | D4 |
| T8' | — | — | — | "0" | "1" | "1" | "1" | "0" | — |

Although in the embodiments described above, for the purpose of inhibiting the production of the musical tone corresponding to the highest key key-code MKC a gate circuit 659 was provided in the highest key detector 6b (FIG. 4) so as not to produce the highest tone producing key code MOKC from the highest key detector 6b, any other method can be used. For example tone production may be inhibited by controlling the operation of the key code memory device 6c, the key-on detector 6d or the second tone production system 7.

Although in the foregoing description a special tone production system 7 was provided for producing the highest tone of a depressed key, a solo musical tone producing system for performing a solo may be used for producing the highest tone. In such a case a selector is provided for selecting either one of a key code produced by the depressed key detector for a solo keyboard and representing the depressed keys of the solo keyboard, the key-on signal thereof, and the key code MOKC and the key-on signal MKON produced by the highest tone detector 6 to supply the selected code to the solo musical tone generator.

It should be understood that the electronic musical instrument of this invention is not limited to multiple stage keyboards but also be applied to a single stage keyboard. Further, the condition of inhibiting the tone generation that limits the amount of deviation (separation) of the tone generation can be set to any value instead of 200 cents (2 keys) or 300 cents (3 keys). Furthermore, a lowest tone detector may be substituted for the highest tone detector.

Thus, the electronic musical instrument according to this invention is constructed such that when producing a musical tone by deriving out the highest or lowest tone among the tones produced by depressed keys, the production of a new highest or lower tone is inhibited when the new highest or lowest tone is separated from the previous highest or lowest tone by more than a predetermined interval. For this reason it is possible to prevent a large movement of the tone pitch of the produced musical tones which results in such unnatural performance state in which an accompaniment pitch tone is produced with a melody tone color among the melody performance having rests.

What is claimed is:

1. An electronic musical instrument comprising:

a plurality of keys;

a depressed key detector which detects a plurality of depressed keys among said keys for producing key identifying signals corresponding to the depressed keys;

a highest signal detector which detects a highest signal among said key identifying signals having a highest priority in accordance with a predetermined order of priority;

a musical tone producing unit responsive to the detected highest signal for producing a musical tone of a tone pitch corresponding to said highest signal;

a reference memory device for storing the detected highest signal in accordance with a predetermined condition; and a controller for inhibiting the musical tone producing unit from producing the musical tone according to a relationship between the detected highest signal and an output of said reference memory device.

2. An electronic musical instrument according to claim 1 wherein said controller supplies a tone production inhibition signal to said musical tone producing unit when a newly detected highest signal is deviated to a lower order side of priority by more than a predetermined value from the already detected hightest signal stored in said memory device.

3. An electronic musical instrument according to claim 1 wherein a content of said reference memory device is rewritten when the highest signal produced by said highest signal detector is of to a newly depressed key.

4. An electronic musical instrument according to claim 3 wherein said controller supplies a tone production inhibition signal to said musical tone producing unit when a newly detected highest signal is deviated to a lower order side of priority by more than a predetermined value from the already detected highest signal stored in said memory device.

5. An electronic musical instrument according to claim 1 or 3 wherein a content of said reference memory device is rewritten when said memory device receives said highest signal while production of a musical tone of said musical tone producing unit is not inhibited by said controller.

6. An electronic musical instrument according to claim 4 wherein said controller supplies a tone production inhibition signal to said musical tone producing unit when a newly detected highest signal is deviated to a lower order side of priority by more than a predetermined value from the already detected highest signal stored in said memory device.

7. An electronic musical instrument according to claim 1 wherein a content of said reference memory device is rewritten when said highest signal varies.

8. An electronic musical instrument according to claim 7 wherein said controller supplies a tone production inhibition signal to said musical tone producing unit when a newly detected highest signal is deviated to a lower order side of priority by more than a predetermined value from the already detected highest signal stored in said memory device, and said controller further inhibits the generation of the musical tone by said musical tone producing unit when the newly detected highest signal is deviated to a lower order side of priority from the content of said memory device while said content is such that it has been inhibiting said musical tone producing unit from generating a musical tone.

* * * * *

UNITED STATES PATENT AND TRADEMARK OFFICE

CERTIFICATE OF CORRECTION

PATENT NO. : 4,321,850

DATED : March30, 1982

INVENTOR(S) : Akiyoshi Oya, Hamamatsu; Yasuji Uchiyama, Hamakita, bothof Japan

It is certified that error appears in the above—identified patent and that said Letters Patent is hereby corrected as shown below:

In column 3, line 55, change "to all the the" to --to all the--.

In column 4, line 38, change "rythms" to --rhythms-- in both instances.

In column 17, line 29, change "satified" to --satisfied--.

In column 26, line 60, change "he" to --the--.

In column 27, line 13, change "imputted" to --inputted--.

In Table VIII, column 31, change "ley" to --key--.

In column 40, line 10, change "hightest" to --highest--.

Signed and Sealed this

*Seventeenth* Day of *August 1982*

[SEAL]

*Attest:*

GERALD J. MOSSINGHOFF

*Attesting Officer*

*Commissioner of Patents and Trademarks*